US006829454B2

(12) United States Patent
Miyakawa et al.

(10) Patent No.: US 6,829,454 B2
(45) Date of Patent: Dec. 7, 2004

(54) IMAGE FORMING APPARATUS WITH IMPROVED TRANSFER EFFICIENCY

(75) Inventors: Nobuhiro Miyakawa, Nagano-Ken (JP); Shinji Yasukawa, Nagano-Ken (JP); Nobumasa Abe, Nagano-Ken (JP); Mikio Furumizu, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/224,578

(22) Filed: Aug. 21, 2002

(65) Prior Publication Data

US 2003/0053821 A1 Mar. 20, 2003

(30) Foreign Application Priority Data

Aug. 28, 2001 (JP) ..... 2001-258242
Aug. 28, 2001 (JP) ..... 2001-258243

(51) Int. Cl.[7] ..... G03G 15/00
(52) U.S. Cl. ..... 399/159; 399/161
(58) Field of Search ..... 399/116, 159, 399/161, 162, 302, 308

(56) References Cited

U.S. PATENT DOCUMENTS 5,548,382 A 8/1996 Koshi et al.
5,761,589 A 6/1998 Kido et al.
6,104,903 A * 8/2000 Hara et al. ..... 399/265

FOREIGN PATENT DOCUMENTS

JP 3-062072 3/1991

* cited by examiner

*Primary Examiner*—Hoan Tran
(74) *Attorney, Agent, or Firm*—Sughrue Mion, PLLC

(57) ABSTRACT

By causing the movement of charge from a toner to a latent image carrier, the amount of charge of the toner is lowered to an amount of charge suitable for facilitating the transfer of toner so as to improve the transfer efficiency. For this, an image forming apparatus includes a latent image carrier and a developing means for forming a negatively chargeable toner layer compose of two stories or less on a toner carrier by a toner layer thickness regulating member. An electrostatic latent image on the latent image carrier is developed with the toner to form a visible image and the visible image is transferred to a transfer medium. Further, the work functions ($\Phi_{opc}$) of the surface of the latent image carrier is set to be larger than the work function ($\Phi_t$) of the toner.

17 Claims, 10 Drawing Sheets

FIG. 5

| Organic Photoreceptor | Charge Generation Pigment | Charge Transport Material | Work Function (eV) |
|---|---|---|---|
| OPC 2 | Oxytitanyl phthalocyanine | Styryl Compound [Structural Formula (2)] | 5.47 |
| OPC 3 | Titanyl phthalocyanine | Distyryl Compound [Structural Formula (3)] | 5.50 |
| OPC 4 | Oxytitanyl phthalocyanine | Hydrazone Compound [Structural Formula (3)] | 5.63 |

FIG. 6

| Carrying amount ($mg/cm^2$) | Charge ($\mu c/g$) | Amount of + toner particles (wt%) | Number of + toner particles (wt%) |
|---|---|---|---|
| 0.285 | −26.88 | 0.01 | 0.03 |
| 0.328 | −22.55 | 1.27 | 1.17 |
| 0.340 | −21.05 | 1.35 | 1.25 |
| 0.386 | −19.46 | 1.50 | 1.60 |
| 0.421 | −14.32 | 10.31 | 10.00 |

FIG. 7

| Carrying amount ($mg/cm^2$) | Transfer efficiency (%) | OD value at solid image portion | OD value of fog toner | OD value of reverse transfer toner |
|---|---|---|---|---|
| 0.295 | 99.14 | 1.35 | Nearly 0 | 0.007 |
| 0.328 | 99.66 | 1.47 | Nearly 0 | 0.008 |
| 0.340 | 98.93 | 1.50 | Nearly 0 | 0.008 |
| 0.386 | 98.93 | 1.50 | Nearly 0 | 0.008 |
| 0.431 | 98.92 | 1.51 | 0.008 | 0.046 |

FIG. 11

| Toner (work function) | Organic photoreceptor (work function and total cleaning toner amount) | | Transfer belt (work function) |
|---|---|---|---|
| Toner 1 (5.55eV) | OPC 1 (5.72eV) 39.3g | OPC 2 (5.47eV) 45.1g | Transfer belt (1) (5.69eV) |
| Toner 2 (5.64eV) | | | |
| Toner 3 (5.60eV) | | | |
| Toner 4 (5.49eV) | | | |

FIG. 12

| Toner (work function) | Organic photoreceptor (work function and total cleaning toner amount) | | Transfer belt (work function) |
|---|---|---|---|
| Toner 5 (5.43eV) | OPC 1 (5.72eV) 47.6g | OPC 2 (5.47eV) 54.5g | Transfer belt (1) (5.69eV) |
| Toner 6 (5.55eV) | | | |
| Toner 7 (5.58eV) | | | |
| Toner 8 (5.64eV) | | | |

FIG. 13

| Toner (work function) | Organic photoreceptor (work function) | Transfer belt(work function and total cleaning toner amount) | |
|---|---|---|---|
| | | Transfer belt(1) of the present invention | Transfer belt(2) as comparative example |
| Toner 1 (5.55eV) | OPC 1 (5.47eV) | 5.69eV<br>43.5g | 5.19eV<br>70.3g |
| Toner 2 (5.64eV) | | | |
| Toner 3 (5.60eV) | | | |
| Toner 4 (5.49eV) | | | |

FIG. 14

| Carrying amount (mg/cm$^2$) | Charge (μc/g) | Amount of + toner particles (wt%) | Number of + toner particles (%) |
|---|---|---|---|
| 0.294 | −21.18 | 5.31 | 4.97 |
| 0.368 | −19.58 | 5.55 | 5.12 |
| 0.436 | −13.32 | 14.03 | 14.61 |

FIG. 15

| Carrying amount (mg/cm$^2$) | Transfer efficiency(%) | OD value at solid image portion | OD value of fog toner | OD value of reverse transfer toner |
|---|---|---|---|---|
| 0.294 | 98.00 | 1.20 | 0.003 | 0.009 |
| 0.368 | 98.96 | 1.24 | 0.005 | 0.009 |
| 0.436 | 97.63 | 1.32 | 0.008 | 0.051 |

FIG. 16

| Toner (work function) | Organic photoreceptor (work function) | Transfer belt(work function and total cleaning toner amount) | |
|---|---|---|---|
| | | Transfer belt(1) of the present invention | Transfer belt(2) as comparative example |
| Toner 5 (5.43eV) | OPC 1 (5.47eV) | 5.69eV<br>53.4g | 5.19eV<br>76.1g |
| Toner 6 (5.55eV) | | | |
| Toner 7 (5.58eV) | | | |
| Toner 8 (5.64eV) | | | |

IMAGE FORMING APPARATUS WITH IMPROVED TRANSFER EFFICIENCY

BACKGROUND OF THE INVENTION

The present invention relates to an image forming apparatus employing electrophotographic technology and particularly to an image forming apparatus which transfers a visible toner image formed on a latent image carrier to a recording medium electrostatially.

In a conventional image forming apparatus, a photoreceptor as a latent image carrier such as a photosensitive drum or a photosensitive belt is rotatably supported to the main body of the image forming apparatus. During the image forming operation, a latent image is formed onto a photosensitive layer of the photoreceptor and, after that, is developed with toner particles to form a visible image. Then, the visible image is transferred to a recording medium. For transferring the visible image, there is a known method of transferring the visible image to the recording medium by using a corona transfer, a transfer roller, a transfer drum, or a transfer belt (hereinafter, referred to as a transfer medium).

Such method is employed in monochrome image forming apparatuses. In addition, for a full-color image forming apparatus having a plurality of photoreceptors and developers, there is a known method transferring a plurality of color images on a transfer belt or transfer drums to a recording medium such as a paper in such a manner that the respective color images are sequentially superposed on each other, and then fixing these images. Moreover, an intermediate transferring type is also known in which color images are sequentially primary-transferred to an intermediate transfer medium and the primary-transferred images are secondary-transferred to a recording medium. Arranged on the photoreceptor and transfer medium used for any of the aforementioned methods is a cleaning mechanism for cleaning residual toner particles remaining on the photoreceptor after the development and the transfer to remove toner particles on the photoreceptor.

To improve the transfer efficiency, it is known in the art to set a peripheral velocity difference between the photoreceptor and the transfer medium. The peripheral velocity difference improves the property of stripping toner particles, thereby improving the transfer efficiency. In case of development using a single-component toner, the toner on the development roller is formed into a thin toner layer as uniformly as possible by a regulating blade in order to impart sufficient triboelectric charge to the toner. In this state, the toner is negatively charged by the surface of the development roller and the surface of the end of the regulating blade.

Especially for full-color image forming apparatuses, the modern trend is toward the use of toner of small particle size, uniform, and high circularity in order to improve the transfer efficiency. However, the use of such a toner reduces the fluidity of toner so that it is hard to cause triboelectric charging by the regulating blade. As a result, it is impossible to give sufficient charge so as to create a charge distribution in the toner. It is inevitable that even toner for negative charge includes positively charged toner particles.

In this case, in an image forming apparatus which forms images by negative charge reversal development, there is a problem that positively charged toner particles adhere to non-image portions of a latent image carrier (photoreceptor) so as to make "fog", thus increasing the actual consumption of toner and also increasing the cleaning load of the photoreceptor. For cleaning residual toner particles after transfer from the photoreceptor, a large container for collecting and receiving the cleaning toner particles is necessary. There is also a problem that the fog increases the consumption of toner, leading to increase in running cost of consumable supplies. If a large amount of superplasticizing agent is added as an external additive to the toner in order to improve the fluidity of the toner for resolving the aforementioned problem, there may be another problem of reducing the fixing property.

For uniformly negatively charging a toner, there is a known method of regulating negatively chargeable toner particles on a toner carrier into a thin layer (the number of stories in the layer is 2 or less) by a toner layer thickness regulating member.

However, the regulation of toner particles into a thin layer reduces the rate of carrying toner particles, thus making the charge of the toner too high. Accordingly, the number of excessively negatively charged toner particles, i.e. overcharged toner particles, should be increased, thus unfortunately lowering the transfer efficiency from the organic photoreceptor to the transfer medium.

If charge is conducted under low temperature and low humidity condition or a color original image of low duty is successively printed on plural sheets of paper, the amount of charge of toner becomes too high, that is, toner particles are excessively charged. As a result, the reproducibility of half tone images should be lowered and/or the saturated printing optical density for printing solid images tends to be lowered.

The aforementioned method of setting a peripheral velocity difference between the photoreceptor and the transfer medium for improving the transfer efficiency of toner has a limit of improving the transfer efficiency under the low temperature and low humidity conditions or the high temperature and high humidity condition.

Another type of image forming apparatus will be described now. The image forming apparatus comprises a photoreceptor as a latent image carrier such as a photosensitive drum or a photosensitive belt which is rotatably supported to the main body of the image forming apparatus. During the image forming operation, a latent image is formed onto a photosensitive layer of the photoreceptor and, after that, is developed with toner particles to form a visible image. Then, the visible image is transferred to an intermediate transfer medium such as a transfer drum or a transfer belt (primary transfer) and then transferred again to a recording medium (secondary transfer).

Such method is generally employed in a full-color image forming apparatus in which color images are sequentially primary-transferred to an intermediate transfer medium and the primary-transferred images are secondary-transferred to a recording medium such as a paper at once. Arranged on the photoreceptor is a cleaning mechanism for residual toner particles remaining on the photoreceptor after the development and the transfer.

As toner used for such an image forming apparatus, dual-component toner composed of a developer and a magnetic carrier is generally known. Though the dual-component toner achieves relatively stable developing, the mixing ratio of the developer and the magnetic carrier is easily varied so that the maintenance for the mixing ratio is required. Accordingly, magnetic single-component toner has been developed. However the magnetic single-component toner has such a problem that clear color images are not obtained due to the opacity of magnetic material thereof. On the other hand, non-magnetic single-component toner has been developed as color toner. For obtaining high-quality record images with the non-magnetic single-component toner, there is a problem how to uniformly charge the toner particles In order to solve the aforementioned problem of the non-magnetic single-component toner, Japanese Patent Unexamined publication H3-62072 discloses a toner layer thickness regulating member for a developing device. The toner layer thickness regulating member is made of a metal of which work function is low so as to have not only a function controlling the thickness of a toner layer but also a function actively causing triboelectric charging to the toner layer, thereby making charge uniform. This avoid local variation in the developing concentration due to insufficient charge, prevents deterioration of quality of record images, and equalize the thickness of toner layer.

However, the regulation of toner particles into a thin layer reduces the rate of carrying toner particles, thus making the charge of the toner too high. Accordingly, the number of excessively negatively charged toner particles, i.e. over-charged toner particles, should be increased, with the result that toner particles unfortunately strongly adhere to the intermediate transfer medium at the primary transfer portion, thus lowering the transfer efficiency at the secondary transfer portion.

If charge is conducted under low temperature and low humidity condition or a color original image of low duty is successively printed on plural sheets of paper, the amount of charge of toner becomes too high, that is, toner particles are excessively charged. As a result, the reproducibility of half tone images should be lowered and/or the saturated printing optical density for printing solid images tends to be lowered.

In addition, the aforementioned method of setting a peripheral velocity difference between the photoreceptor and the transfer medium for improving the transfer efficiency of toner has a limit of improving the transfer efficiency under the low temperature and low humidity conditions or the high temperature and high humidity condition.

SUMMARY OF THE INVENTION

It is a first object of the present invention to provide an image forming apparatus, capable of resolving the aforementioned conventional problems, which comprises a latent image carrier and a developing means for forming a negatively chargeable toner layer, of which the number of stories is 2 or less, on a toner carrier by a toner layer thickness regulating member, wherein an electrostatic latent image on the latent image carrier is developed with the toner into a visible image and said visible image is transferred to a transfer medium, and which prevents the movement of charge from the latent image carrier to the toner, thereby preventing the toner particles from excessively charged and improving the transfer efficiency.

To accomplish the aforementioned object, an image forming apparatus according to claims 1 through 9 comprises: a latent image carrier; and a developing means for forming a negatively chargeable toner layer composed of two stories or less on a toner carrier by a toner layer thickness regulating member, wherein an electrostatic latent image on the latent image carrier is developed with said toner to form a visible image and said visible image is transferred to a transfer medium, and is characterized in that the work function ($\Phi_{opc}$) of the surface of said latent image carrier is set to be larger than the work function ($\Phi_t$) of the toner.

According to the invention of claims 1 through 9, the amount of positively charged toner particles which are charged into the opposite polarity can be reduced by regulating toner particles into a thin layer. As a result, the amount of fog toner particles can be reduced. In this case, however, the regulation of toner particles into a thin layer generally makes the toner to be easily negatively charged, thus unfortunately lowering the transfer efficiency after development. However, since the work functions of the toner and the latent image carrier are set to have a relation: $\Phi_{opc} \geqq \Phi_t$, no charge moves from the latent image carrier to the toner after the development so that there is no chance that the toner is further negatively charged at the contact portion, thus inhibiting the excessive charge of toner. Since the excessive charge is inhibited, toner particles can be effectively transferred from the latent image carrier to the transfer medium at the primary transfer portion where transfer is conducted according to the constant voltage method. At the secondary transfer portion of the intermediate transfer medium, toner particles can be effectively transferred from the intermediate transfer medium to the receiving medium (such as a paper) because of relatively small triboelectric power of the toner to the intermediate transfer medium. As a result, the amount of residual toner particles remaining on the latent image carrier or the transfer medium becomes little, thereby reducing the cleaning load and the cleaning toner amount. Accordingly, the volume of a container for collecting and receiving the cleaning toner particles can be reduced to be ⅓ or less of the volume of the conventional container. Since the miniaturization of the image forming apparatus itself is achieved and the transfer efficiency is improved, the amount of residual toner on the latent image carrier is reduced, thereby reducing the cleaning load of a cleaning member, leading to the improvement of durability.

It is a second object of the present invention to provide an image forming apparatus, capable of resolving the aforementioned conventional problems, which comprises a latent image carrier and a developing means for forming a negatively chargeable toner layer on a toner carrier by a toner layer thickness regulating member, wherein an electrostatic latent image on the latent image carrier is developed with the toner into a visible image and said visible image is transferred to an intermediate transfer medium, and which reduces the amount of over-charged toner particles to be transferred to the intermediate transfer medium to prevent the toner particles from strongly adhering to the intermediate transfer medium at the primary transfer portion, thereby improving the transfer efficiency at the secondary transfer portion.

To resolve the aforementioned object, an image forming apparatus according to claims 10 through 17 comprises: a latent image carrier; and a developing means for forming a negatively chargeable toner layer on a toner carrier by a toner layer thickness regulating member, wherein an electrostatic latent image on the latent image carrier is developed with said toner to form a visible image and said visible image is transferred to an intermediate transfer medium, and is characterized in that the work function ($\Phi_{TM}$) of the surface of the intermediate transfer medium is set to be larger than the work function ($\Phi_t$) of the toner.

According to the invention of claims 10 through 17, in the image forming apparatus comprising a developing means for forming a negatively chargeable toner layer on a toner carrier by a toner layer thickness regulating member, wherein an electrostatic latent image on the latent image carrier is developed with said toner to form a visible image and said visible image is transferred to an intermediate transfer medium, the work function ($\Phi_{TM}$) of the surface of the intermediate transfer medium is set to be larger than the work function ($\Phi_t$) of the toner. At the primary transfer portion, since the excessive charge is inhibited by the contact between the intermediate transfer medium and the toner, the amount of toner particles which are excessively charged due to the regulation into a thin toner layer can be reduced. At the secondary transfer portion of the intermediate transfer medium, toner particles can be effectively transferred from the intermediate transfer medium to the receiving medium (such as a paper) because triboelectric power of the toner to the intermediate transfer medium is restrained. As a result, the amount of residual toner particles remaining on the latent image carrier or the transfer medium becomes little, thereby reducing the cleaning load and the cleaning toner amount. Accordingly, the volume of a container for collecting and receiving the cleaning toner particles can be reduced to be ½ or less of the volume of the conventional container. Since the miniaturization of the image forming apparatus itself is achieved and the transfer efficiency is improved, the amount of residual toner on the latent image carrier is reduced, thereby reducing the cleaning load of a cleaning member, leading to the improvement of durability.

By regulating toner particles into a thin layer, the toner can be uniformly charged. As a result, the amount of fog toner particles can be reduced by reducing the amount of positively charged toner particles which are charged into the opposite polarity.

Even in case of single-component development with a toner which is regulated into a thin layer for uniformly charged, the work function ($\Phi_{TM}$) of the surface of the intermediate transfer medium is set to be larger than the work function ($\Phi_t$) of the toner, thereby preventing the toner from being further negatively charged at the contact portion with the intermediate transfer medium. As a result of this, the transfer efficiency when a constant voltage source is employed can be improved even though the toner is regulated into a thin layer.

BRIEF DESCRIPTION OF THE DRAWINGS

FIGS. 5-7 are tables showing results of experiments according to the present invention;

FIGS. 9-16 are tables or charts showing results of experiments according to the present invention;

DESCRIPTION OF THE PREFERRED EMBODIMENTS

Figure 1:
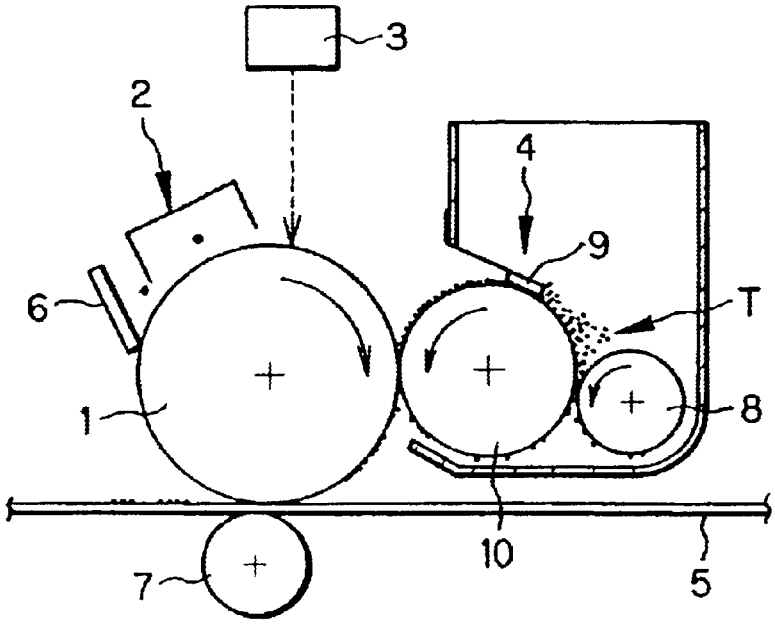
FIG. 1 is an explanatory illustration showing an example of the image forming apparatus of a contact developing type according to the present invention.
Figure 2:
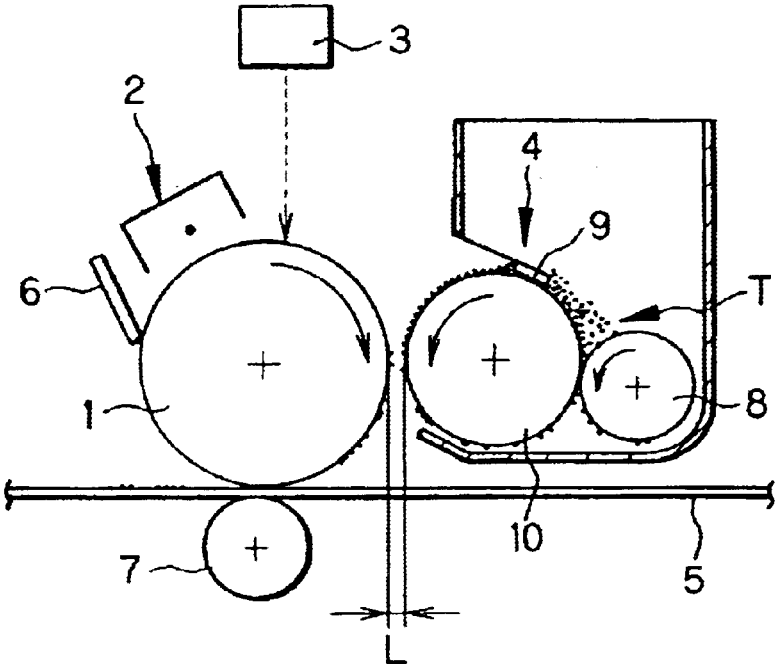
FIG. 2 is an explanatory illustration showing an example of the image forming apparatus of a non-contact developing type according to the present invention.

FIG. 1 shows an example of the image forming apparatus of a contact developing type according to the present invention and FIG. 2 shows an example of the image forming apparatus of a non-contact developing type according to the present invention. It should be noted that the image forming apparatuses of the present invention employ a developing type using a single-component non-magnetic toner.

In FIG. 1 and FIG. 2, arranged around a latent image carrier (organic photoreceptor) 1 are a charging means 2, an exposing means 3, a developing means 4, a recording medium or an intermediate transfer belt (transfer medium) 5, and a cleaning means 6. Numeral 7 designates a backup roller, 8 designates a toner supplying roller, 9 designates a toner regulating blade (toner layer thickness regulating member), 10 designates a development roller (toner carrier), a mark T designates a non-magnetic single-component toner.

The organic photoreceptor 1 may be of a single-layer organic type or a multi-layer organic type. A multi-layer organic photoreceptor consists of a charge generation layer and a charge transport layer which are sequentially laminated on a conductive substrate via an undercoat layer.

As the conductive substrate, a known conductive substrate, for example, having conductivity less than volume resistance $10^{10}$ Ωcm can be used. Specific examples are a tubular substrate formed by machining aluminum alloy, a substrate made of polyethylene terephthalate film which is provided with conductivity by vapor deposition of aluminum or by conductive paint, and a tubular substrate formed by molding conductive polyimide resin. The conductive substrate may have a tubular shape, a belt-like shape, a plate shape, or a sheet shape. In addition, a seamless metallic belt made by processing a nickel electrocast tube or a stainless steel tube may be suitably employed.

As the undercoat layer formed on the conductive substrate, a known undercoat layer may be used. For example, the undercoat layer is disposed for improving the adhesive property, preventing moiré phenomenon, improving the coating property of the charge generation layer as an upper layer thereof, and/or reducing residual potential during exposure. The resin as material of the undercoat layer preferably has high insoluble property relative to solvent used for a photosensitive layer because the photosensitive layer is applied on the resin. Examples of available resins are water soluble resins such as polyvinyl alcohol, casein, sodium polyacrylic acid, alcohol soluble resins such as polyvinyl acetate, copolymer nylon, and methoxymethylate nylon, polyurethane, melamine resin, and epoxy resin. The foregoing resins may be used alone or in combination. These resins may contain metallic oxide such as titanium dioxide or zinc oxide.

As the charge generation pigment for use in the charge generation layer, a known material may be used. Specific examples are phthalocyanine pigments such as metallic phthalocyanine, metal-free phthalocyanine, azulenium salt pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bis-stilbene skeleton, azo pigments having a distyryl oxadiazole skeleton, azo pigments having a distyryl carbazole skeleton, perylene pigments, anthraquinone pigments, polycyclic quinone pigments, quinone imine pigments, diphenylmethane pigments, triphenylmethane pigments, benzoquinone pigments, naphthoquinone pigments, cyanine pigments, azomethine pigments, indigoid pigments, and bisbenzimidazole pigments. The foregoing charge generation pigments may be used alone or in combination.

Examples of the binder resin for use in the charge generation layer include polyvinyl butyral resin, partially acetalized polyvinyl butyral resin, polyarylate resin, and vinyl chloride-vinyl acetate copolymer. As for the structural ratio between the binder resin and the charge generation material, the charge generation material is in a range from 10 to 1000 parts by weight relative to 100 parts by weight of the binder resin.

As the charge transport material for use in the charge transport layer, conventional materials may be used and the charge transport material is divided into an electron transport material and a positive hole transport material. Examples of the electron transport material include electron acceptor materials such as chloroanil, tetracyanoethylene, tetracyanoquinodimethane, 2,4,7-trinitro-9-fluorenone, palladiphenoquinone derivatives, benzoquinone derivatives, and naphthoquinone derivatives. These electron transport materials may be used alone or in combination.

Examples of the positive hole transport material include oxazole compounds, oxadiazole compounds, imidazole compounds, triphenylamine compounds, pyrazoline compounds, hydrazone compounds, stilbene compounds, phenazine compounds, benzofuran compounds, buthaziene compounds, benzizine compounds and, derivatives thereof. These electron donor materials may be used alone or in combination.

The charge transport layer may contain antioxidant, age resistor, ultraviolet ray absorbent or the like for preventing deterioration of the aforementioned materials.

Examples of the binder resins for use in the charge transport layer include polyester, polycarbonate, polysulfone, polyarylate, poly-vinyl butyral, poly-methyl methacrylate, poly-vinyl chloride resin, vinyl chloride-vinyl acetate copolymer, and silicone resin. Among these, polycarbonate is preferable in view of the compatibility with the charge transport material, the layer strength, the solubility, and the stability as coating material. As for the structural ratio between the binder resin and the charge transport material, the charge transport material is in a range from 25 to 300 parts by weight relative to 100 parts by weight of the binder resin.

It is preferable to use a coating liquid for forming the charge generation layer and the charge transport layer. Example of solvents for use in the coating liquid include alcohol solvents such as methanol, ethanol, and isopropyl alcohol, ketone solvents such as acetone, methyl ethyl ketone, and cyclohexanone, amide solvents such as N,N-dimethylformamide, and N,N-dimethylacetamide, ether solvents such as tetrahydrofuran, dioxane, and ethylene glycol monomethyl ether, ester solvents such as methyl acetate and ethyl acetate, aliphatic halogenated hydrocarbon solvents such as chloroform, methylene chloride, dichloroethylene, carbon tetrachloride, and trichloroethylene, and aromatic solvents such as benzene, toluene, xylene, and monochlor benzene. Selection from the above solvents depends on the kind of used binder resin.

For dispersing the charge generation pigment, it is preferable to disperse and mix by using a mechanical milling/dispersion method such as a sand mill method, a ball mill method, an attritor method, a planetary mill method.

Examples of the coating method for the undercoat layer, the charge generation layer and the charge transport layer include a dip coating method, a ring coating method, a spray coating method, a wire bar coating method, a spin coating method, a blade coating method, a roller coating method, and an air knife coating method. After coating, it is preferable to dry them at room temperature and then, heat-dry them at a temperature from 30 to 200° C. for 30 to 120 minutes. The thickness of the charge generation layer after being dried is in a range from 0.05 to 10 $\mu$m, preferably from 0.1 to 3 $\mu$m. The thickness of the charge transport layer after being dried is in a range from 5 to 50 $\mu$m, preferably from 10 to 40 $\mu$m.

A single-layer type organic photosensitive layer is formed by coating a mixture of a charge generation material, a charge transport material, a sensitizer, a binder, a solvent, and the like onto a conductive substrate as described in the aforementioned organic laminated photoreceptor via an undercoat layer. The negatively chargeable single-layer type organic photoreceptor may be made according to the disclosure of Japanese Patent Unexamined Publication 2000-19746.

Examples of charge generation materials for use in the single-layer type organic photosensitive layer are phthalocyanine pigments, azo pigments, quinone pigments, perylene pigments, quinocyanine pigments, indigoid pigments, bisbenzimidazole pigments, and quinacridone pigments. Among these, phthalocyanine pigments and azo pigments are preferable. Examples of charge transport materials are organic positive hole transport compounds such as hydrazone compounds, stilbene compounds, phenylamine compounds, arylamine compounds, diphenyl buthaziene compounds, and oxazole compounds. Examples of the sensitizers are electron attractive organic compounds such as palladiphenoquinone derivatives, naphthoquinone derivatives, and chloroanil, which are also known as charge transport materials. Examples of the binders are thermoplastic resins such as polycarbonate resin, polyarylate resin, and polyester resin.

Proportions of the respective components are the binder: 40–75% by weight, the charge generation material: 0.5–20% by weight, the charge transport material: 10–50% by weight, the sensitizer: 0.5–30% by weight, preferably the binder: 45–65% by weight, the charge generation material: 1–20% by weight, the charge transport material: 20–40% by weight, and the sensitizer: 2–25% by weight. The solvent is preferably a solvent being insoluble relative to the undercoat layer. Examples of the solvent are toluene, methyl ethyl ketone, and tetrahydrofuran.

The respective components are milled and dispersed by a mixing apparatus such as a homo mixer, a ball mill, a sand mill, an attritor, or a paint conditioner so as to create a coating liquid. The coating liquid is applied on the undercoat layer by the dip coating method, the ring coating method, or the spray coating method to have a thickness after dried of 15 to 40 $\mu$m, preferably 20 to 35 $\mu$m, thereby forming a single-layer type organic photosensitive layer.

The non-magnetic single-component toner (hereinafter, referred to as "toner") may be prepared by the pulverization method. For making toner using the pulverization method, a resin binder, a pigment, a release agent, and a charge control agent are uniformly mixed by a Henschel mixer, melt and kneaded by a twin-shaft extruder. After cooling process, they are classified through the rough pulverizing-fine pulverizing process. Further, a fluidity improving agent is added as an external additive. In this manner, the toner is obtained.

As the binder resin, a known binder resin for toner may be used. Preferable examples are homopolymers or copolymers containing styrene or styrene substitute which are resins of styrene series, such as polystyrene, poly-α-methyl styrene, chloropolystyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylate ester copolymer, styrene-methacrylate ester copolymers, styrene-acrylate ester-methacrylate ester copolymers, styrene-α-chloracrylic methyl copolymer, styrene-acrylonitrile-acrylic copolymers, and styrene-vinyl methyl ether copolymers; polyester resins, epoxy resins, polyurethane modified epoxy resins, silicone modified epoxy resin, vinyl chloride resins, rosin modified maleic acid resins, phenyl resins, polyethylene, polypropylene, ionomer resins, polyurethane resins, silicone resins, ketone resins, ethylene-ethylacrylate copolymers, xylene resins, polyvinyl butyral resins, terpene resins, phenolic resins, and aliphatic or alicyclic hydrocarbon resins. These resins may be used alone or in blended state. Among these resins, styrene-acrylate ester-based resins, styrene-methacrylate ester-based resins, and polyester resins are especially preferable in the present invention. According to the present invention, the binder resin preferably has a glass-transition temperature in a range from 50 to 75° C. and a flow softening temperature in a range from 100 to 150° C.

As the coloring agent, a known coloring agent for toner may be used. Examples are Carbon Black, Lamp Black, Magnetite, Titan Black, Chrome Yellow, Ultramarine Blue, Aniline Blue, Phthalocyanine Blue, Phthalocyanine Green, Hansa Yellow G, Rhodamine 6G, Chalcone Oil Blue, Quinacridon, Benzidine Yellow, Rose Bengal, Malachite Green lake, Quinoline Yellow, C.I. Pigment red 48:1, C.I. Pigment red 122, C.I. Pigment red 57:1, C.I. Pigment red 122, C.I. Pigment red 184, C.I. Pigment yellow 12, C.I. Pigment yellow 17, C.I. Pigment yellow 97, C.I. Pigment yellow 180, C.I. Solvent yellow 162, C.I. Pigment blue 5:1, and C.I. Pigment blue 15:3. These dyes and pigments can be used alone or in blended state.

As the release agent, a known release agent for toner may be used. Specific examples are paraffin wax, micro wax, microcrystalline wax, candelilla wax, carnauba wax, rice wax, montan wax, polyethylene wax, polypropylene wax, oxygen convertible polyethylene wax, and oxygen convertible polypropylene wax. Among these, polyethylene wax, polypropylene wax, carnauba wax, or ester wax is preferably employed.

As the charge control agent, a known charge control agent for toner may be used. Specific examples are Oil Black, Oil Black BY, Bontron S-22 (available from Orient Chemical Industries, LTD.), Bontron S-34 (available from Orient Chemical Industries, LTD.); metal complex compounds of salicylic acid such as E-81 (available from Orient Chemical Industries, LTD.), thioindigo type pigments, sulfonyl amine derivatives of copper phthalocyanine, Spilon Black TRH (available from Hodogaya Chemical Co., Ltd.), calix arene type compounds, organic boron compounds, quaternary ammonium salt compounds containing fluorine, metal complex compounds of monoazo, metal complex compounds of aromatic hydroxyl carboxylic acid, metal complex compounds of aromatic di-carboxylic acid, and polysaccharides. Among these, achromatic or white agents are especially preferable for color toner.

Proportions (by weight) in the toner prepared by the pulverization are the coloring agent: 0.5–15 parts, preferably 1–10 parts, the release agent: 1–10 parts, preferably 2.5–8 parts, and the charge control agent: 0.1–7 parts, preferably 0.5–5 parts relative to 100 parts of the binder resin.

The toner prepared by the pulverization as mentioned above has a mean particle diameter ($D_{50}$) from 5 μm to 10 μm, preferably 6 μm to 9 μm, and a distribution in which particles having a particle diameter of 3 μm or less occupy 20% or less, preferable 10% or less, based on the number.

In the toner prepared by the pulverization according to the present invention, in order to improve the transfer efficiency, the toner is preferably spheroidized. For this, it is preferable to use such a machine allowing the toner to be pulverized into relatively spherical particles. For example, when the pulverization is carried by using a turbo mill (available from Kawasaki Heavy Industries, Ltd.), the degree of circularity of 0.94 or more can be achieved.

The polymerized toner may be prepared by suspension polymerization method or emulsion polymerization method. In the suspension polymerization, a monomer compound is prepared by melting or dispersing a polymerizable monomer, a coloring agent, a release agent, and, if necessary, a dye, a polymerization initiator, across-linking agent, a charge control agent, and other additive(s). By adding the monomer compound into an aqueous phase containing a suspension stabilizer (water soluble polymer, hard water soluble inorganic material) with stirring, the monomer compound is granulated and polymerized, thereby forming unicolor toner particles having a desired particle size.

In the emulsion polymerization, a monomer, a release agent and, if necessary, a polymerization initiator, an emulsifier (surface active agent), and the like are dispersed into a water and are polymerized. During the coagulation, a coloring agent, a charge control agent, and a coagulant (electrolyte) are added, thereby forming unicolor toner particles having a desired particle size.

Among the materials for the polymerization method, the coloring agent, the release agent, the charge control agent, and the fluidity improving agent may be the same materials for the toner prepared by the pulverization.

As the polymerizable monomer, a known monomer of vinyl series may be used. Examples include: styrene, o-methylstyrene, m-methylstyrene, p-methylstyrene, α-methylstyrene, P-methoxystyrene, p-ethylstyrene, vinyl toluene, 2,4-dimethylstyrene, p-n-butylstyrene, p-phenylstyrene, p-chlorostyrene, di-vinylbenzene, methyl acrylate, ethyl acrylate, propyl acrylate, n-butyl acrylate, isobutyl acrylate, n-octyl acrylate, dodecyl acrylate, hydroxyethyl acrylate, 2-ethyl hexyl acrylate, phenyl acrylate, stearyl acrylate, 2-chloroethyl acrylate, methyl methacrylate, ethyl methacrylate, propyl methacrylate, n-butyl methacrylate, isobutyl methacrylate, n-octyl methacrylate, dodecyl methacrylate, hydroxyethyl methacrylate, 2-ethyl hexyl methacrylate, stearyl methacrylate, phenyl methacrylate, acrylic acid, methacrylic acid, maleic acid, fumaric acid, cinnamic acid, ethylene glycol, propylene glycol, maleic anhydride, phthalic anhydride, ethylene, propylene, butylene, isobutylene, vinyl chloride, vinylidene chloride, vinyl bromide, vinyl fluoride, vinyl acetate, vinyl propylene, acrylonitrile, methacrylonitrile, vinyl methyl ether, vinyl ethyl ether, vinyl ketone, vinyl hexyl ketone, and vinyl naphthalene. Examples of fluorine-containing monomers are 2,2,2-torifluoroethylacrylate, 2,2,3,3-tetrafluoropropylacrylate, vinyliden fluoride, ethylene trifluororide, ethylene tetrafluoride, and trifluoropropyrene. These are available because the fluorine atoms are effective for negative charge control.

As the emulsifier (surface active agent), a known emulsifier may be used. Examples are dodecyl benzene sulfonic acid sodium, sodium-tetradecyl sulfate, pentadecyl sodium sulfate, sodium octylsulphate, sodium oleate, sodium laurate, potassium stearate, calcium oleate, dodecylammonium chloride, dodecylammonium bromide, dodecyltrimethylammonium bromide, dodecylpyridinium chloride, hexadecyltrimethylammonium bromide, dodecylpolyoxy ethylene ether, hexadecylpolyoxy ethylene ether, laurylpolyoxy ethylene ether, and sorbitan monooleate polyoxy ethylene ether.

As the polymerization initiators, a known polymerization initiator may be used. Examples include potassium persulfate, sodium persulfate, ammonium persulfate, hydrogen peroxide, 4,4'-azobis-cyano valeric acid, t-butyl hydro peroxide, benzoyl peroxide, and 2,2'-azobis-isobutyronitrile.

As the coagulant (electrolyte), a known coagulant maybe used. Examples include sodium chloride, potassium chloride, lithium chloride, magnesium chloride, calcium chloride, sodium sulfate, potassium sulfate, lithium chloride, magnesium sulfate, calcium sulfate, zinc sulfate, aluminum sulfate, and iron sulfate.

Description will be made as regard to how to adjust the degree of circularity of the toner prepared by the polymerization. In the emulsion polymerization method, the degree of circularity can be freely changed by controlling the temperature and time in the coagulating process of secondary particles. The degree of circularity is in a range from 0.94 to 1.00. The suspension polymerization method enables to make perfect spherical toner particles. The degree of circularity is in a range from 0.98 to 1.00. By heating the toner particles at a temperature higher than the glass-transition temperature of toner to deform them for adjusting the circularity, the degree of circularity can be freely adjusted in a range from 0.94 to 0.98.

There is another method for preparing a polymerized toner, which is a dispersion polymerization method. This method is disclosed in, for example, Japanese Patent Unexamined Publication No. 63-304002. In this case, since the shape of each particle may be close to the perfect sphere, the particles are heated at a temperature higher than the glass-transition temperature of toner so as to form the particles into a desired shape.

The toner prepared by polymerization as mentioned above has a mean particle diameter ($D_{50}$) from 4 $\mu$m to 9 $\mu$m, preferably 4.5 $\mu$m to 8 $\mu$m, and a distribution in which particles having a particle diameter of 3 $\mu$m or less occupy 5% or less, preferable 3% or less, based on the number.

The toner prepared by either of the pulverization or the polymerization according to the present invention preferably has a degree of circularity (sphericity) of 0.94 or more, more preferably 0.95 or more. In case of the degree of circularity up to 0.97, a cleaning blade is preferably used. In case of the higher degree, a brush cleaning is preferably used with the cleaning blade. The degree of circularity (sphericity) of 0.94 or more improves the transfer efficiency.

As the fluidity improving agent, a known inorganic or organic fluidity improving agent for toner may be used. Examples are fine particles of silica, titanium dioxide, alumina, magnesium fluoride, silicon carbide, boron carbide, titanium carbide, zirconium carbide, boron nitride, titanium nitride, zirconium nitride, magnetite, molybdenum disulfide, aluminum stearate, magnesium stearate, zinc stearate, calcium stearate, metallic salt titanate, and silicon metallic salt. These fine particles are preferably processed by a hydrophobic treatment with a silane coupling agent, a titanate coupling agent, a higher fatty, silicone oil. Besides the aforementioned fine particles, examples include acrylic resin, styrene resin, and fluororesin. These fluidity improving agents can be used alone or in blended state. The adding amount of the fluidity improving agent is preferably from 0.1 to 5% by weight, more preferably from 0.5 to 4.0% by weight relative to the toner.

The fluidity improving agent as an external additive of toner preferably has a mean particle diameter ($D_{50}$) of primary particles in a range from 5 to 150 nm, more preferably in a range from 7 to 100 nm, and a specific surface area of 2 to 500 $m^2/g$, more preferably in the range of from 5 to 400 $m^2/g$, as measured according to the BET method. In the present invention, the mean particle diameters and the degrees of circularity of the toner particles are measured by FPIA2100 available from Sysmex Corporation.

In the image forming apparatus of the present invention, the toner, the latent image carrier, and the intermediate transfer medium are evaluated according to their work functions measured by the following measuring method. The work function ($\Phi$) is known as minimum energy necessary for taking out one electron from the substance. The smaller the work function of a substance is, it is easier to take out electrons from the substance. The larger the work function of a substance is, it is harder to take out electrons from the substance. Accordingly, when a substance having a small work function and a substance having a great work function are in contact with each other, the substance having a small work function is positively charged and the substance having a great work function is negatively charged. Work function can be measured by a method as described below and can be numerically indicated as energy (eV) necessary for taking out one electron from the substance. Based on work functions, charging property by contacts between toner consisting of various substances and respective members of the image forming apparatus can be evaluated.

Work function ($\Phi$) is measured by the use of a surface analyzer (Low energy electron spectrometer AC-2, produced by Riken Keiki Co., Ltd). According to the present invention, in the analyzer in which a heavy hydrogen lump is used, the radiation amount for the development roller plated with metal is set to 10 nW, the radiation amount for other members is set to 500 nW, and a monochromatic beam is selected by a spectrograph, samples are radiated with a spot size of 4 square mm, an energy scanning range of 3.4–6.2 eV, and a measuring time of 10 sec/one point. The quantity of photoelectrons emitted from each sample surface is detected. Work function is calculated by using a work function calculating software based on the quantity of photoelectron and measured with repeatability (standard deviation) of 0.02 eV. For ensuring the repeatability of data, the samples to be measured are left for 24 hours at environmental temperature and humidity of 25° C., 55% RH before measurement.

Figure 17A:
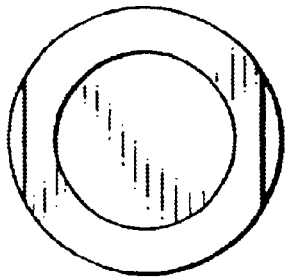
FIGS. 17(*a*), 17(*b*) are illustrations showing a measurement cell used for measuring the work function of the toner, wherein FIG. 17(*a*) is a front view thereof and FIG. 17(*b*) is a side view thereof.
Figure 17B:
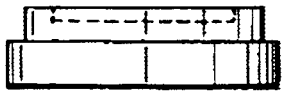

A measurement cell for sample toners is a stainless steel disk which is 13 mm in diameter and 5 mm in height and is provided at the center thereof with a toner receiving concavity which is 10 mm in diameter and 1 mm in depth as shown in FIGS. 17(*a*), 17(*b*). For measurement, toner is entered in the concavity of the cell by using a weighting spoon without pressure and then is leveled by using a knife edge. The measurement cell filled with the toner is fixed to a sample stage at a predetermined position. Then, measurement is conducted under conditions that the radiation amount is set to 500 nW, and the spot size is set to 4 square mm, the energy scanning range is set to 4.2–6.2 eV in the same manner as described later with reference to FIG. 18(*b*).

Figure 18A:
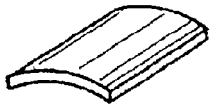
FIGS. 18(*a*), 18(*b*) are illustrations for explaining the method of measuring the work function of a cylindrical member of the image forming apparatus, wherein FIG. 18(*a*) is a perspective view showing the configuration of a test piece for measurement and FIG. 18(*b*) is an illustration showing the measuring state.
Figure 18B:
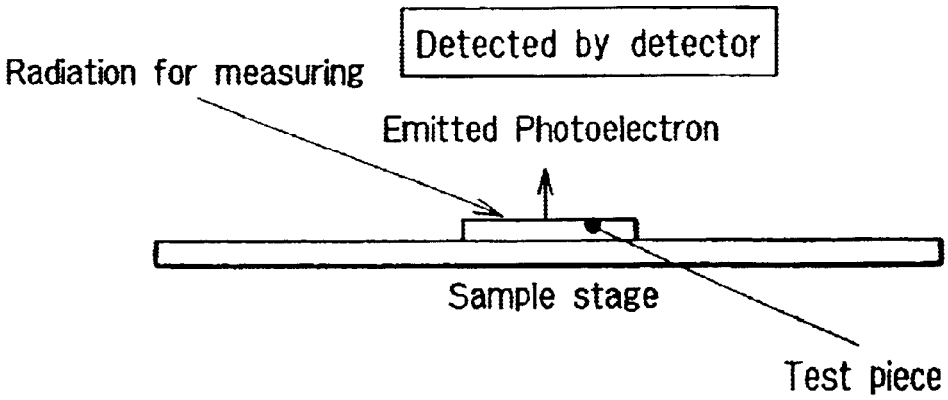

In case that the sample is a cylindrical member of the image forming apparatus such as a photoreceptor or a development roller, the cylindrical member is cut to have a width of 1–1.5 cm and is further cut in the lateral direction along ridge lines so as to obtain a test piece of a shape as shown in FIG. 18(*a*). The test piece is fixed to the sample stage at the predetermined position in such a manner that a surface to be radiated is parallel to the direction of radiation of measurement light as shown in FIG. 18(*b*). Accordingly, photoelectron emitted from the test piece can be efficiently detected by a detector (photomultiplier).

In case of an intermediate transfer belt, a regulating blade, or a sheet-like photoreceptor, such a member is cut to have at least 1 square cm as a test piece because the radiation is conducted to a spot of 4 square mm. The test piece is fixed to the sample stage and measured in the same manner as described with reference to FIG. 18(*b*).

Figure 19:
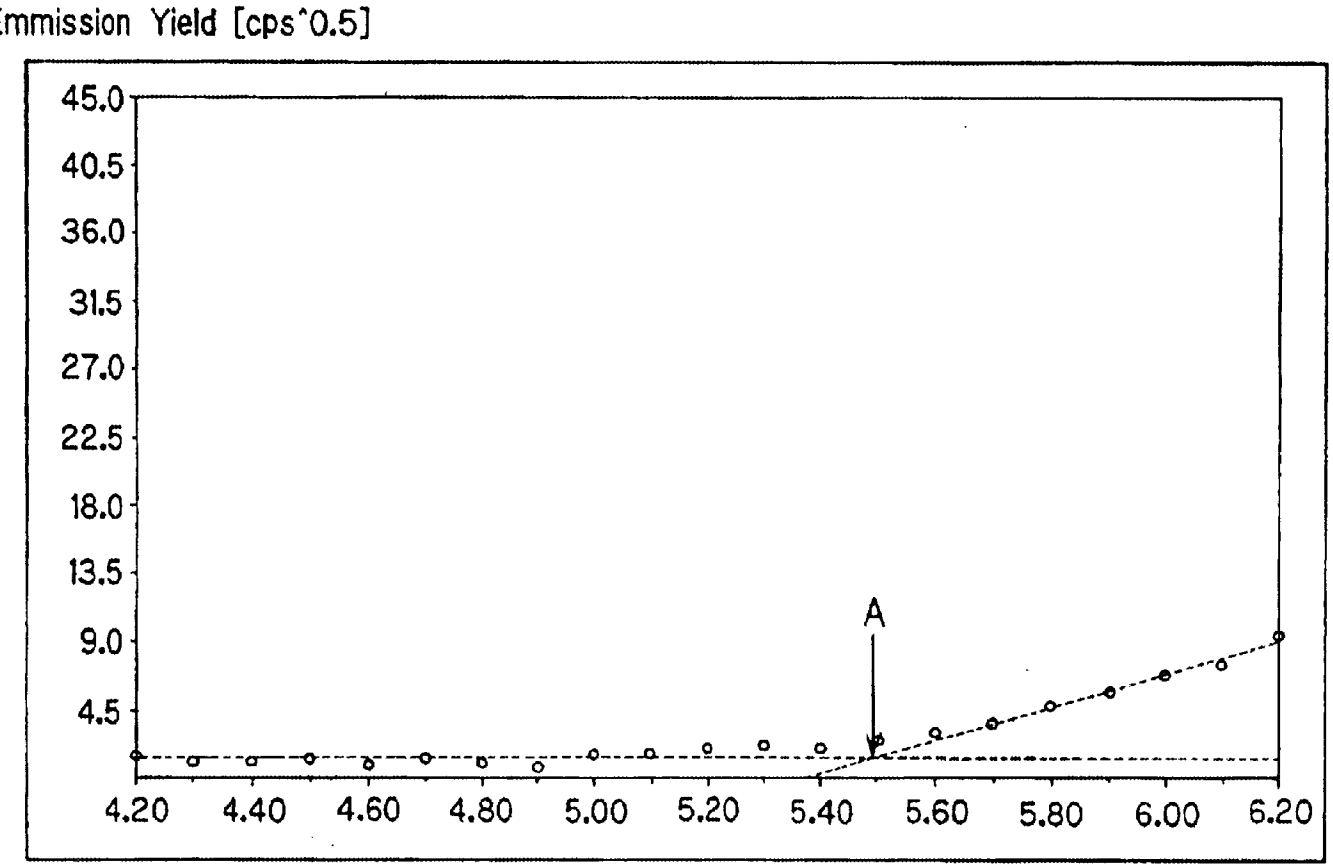
FIG. 19 is a chart showing measurement of the work function of toner of the present invention by using a surface analyzer.

In this surface analysis, photoelectron emission is started at a certain energy value (eV) while scanning excitation energy of monochromatic beam from the lower side to the higher side. The energy value is called "work function (eV)". FIG. 19 shows an example (toner 4) of chart obtained by using the surface analyzer. FIG. 19 plots excitation energy (eV) as the abscissa and normalized photon yield ("n" power of photoelectron yield per unit photon) as the ordinate so that a constant gradient (Y/eV) is obtained. In FIG. 19, the work function is indicated by an excitation energy (eV) at a critical point A.

The image forming apparatus according to claims 1 through 9 of the present invention comprises a latent image carrier, and a developing means for forming a negatively chargeable toner layer composed of two stories or less on a toner carrier by a toner layer thickness regulating member, wherein an electrostatic latent image on the latent image carrier is developed with the toner to form a visible image and the visible image is transferred to a transfer medium. The image forming apparatus is characterized in that the work function ($\Phi_{opc}$) of the surface of the latent image carrier is set to be larger than the work function ($\Phi_t$) of the toner.

If negatively chargeable toner particles on the toner carrier are regulated into a thin layer (the number of stories in the layer is 2 or less) for uniformly negatively charging the toner, the rate of carrying toner particles is reduced, thus making the charge of the toner too high. Accordingly, the number of excessively negatively charged toner particles, i.e. over-charged toner particles, should be increased, thus unfortunately lowering the transfer efficiency from the organic photoreceptor to the transfer medium.

To solve the above problems, the work function ($\Phi_{opc}$) of the surface of the latent image carrier is set to be larger than the work function ($\Phi_t$) of the toner so as not to allow the movement of the charge from the latent image carrier to the toner, thereby inhibiting the excessive charge of the toner. As a result, the transfer efficiency can be improved.

By setting a peripheral velocity difference between the latent image carrier and the transfer medium, the excessive charge of the toner can be prevented. In this case, the peripheral velocity difference between the latent image carrier and the intermediate transfer medium is set not to exceed 5%, thereby inhibiting occurrence of flush during transfer operation and thus practically obtaining high-quality images. Positively charged toner particles adhering to the latent image carrier are negatively charged, thereby reducing the amount of positively charged toner particles. The peripheral velocity difference between the latent image carrier and the intermediate transfer medium is preferably in a range from 0.3% to 3%.

The developing means regulates the toner layer thickness on the toner carrier to have 2 stories or less and controls the toner carrying amount A (mg/cm$^2$) to satisfy:

$$A=0.058D\pm0.1,$$

and preferably satisfy:

$$A=0.058D\pm0.05,$$

wherein D is the mean particle diameter ($\mu$m) of the toner based on the number.

The peripheral velocity ratio of the development roller relative to the latent image carrier is set in a range from 1.2 to 2.5, preferably from 1.4 to 2.2 because of the regulation of thin toner layer, and the rotational directions of the latent image carrier and the development roller are set to have the same direction at a portion where they are in contact with or confront each other.

The developer is a negatively chargeable toner and the latent image carrier is a negatively chargeable organic photoreceptor. The negatively chargeable toner has a degree of circularity of 0.94 or more and has a mean particle diameter of 4.5 $\mu$m to 9 $\mu$m based on the number.

FIG. 1 shows an example of the image forming apparatus of a contact developing type according to the present invention. A photoreceptor 1 is a photosensitive drum which is 24 mm to 86 mm in diameter and rotates at a surface velocity from 60 mm/sec to 300 mm/sec. After the surface of the photoreceptor 1 is uniformly negatively charged by a corona charging device 2, the photoreceptor 1 is exposed by an exposure device 3 according to information to be recorded. In this manner, an electrostatic latent image is formed on the photoreceptor 1.

A developing means 4 composed of a development roller 10 is a single-component developing device which supplies a non-magnetic single-component toner T to the organic photoreceptor to reverse-developing the electrostatic latent image on the organic photoreceptor, thereby forming a visible image. The non-magnetic single-component toner T is housed in the developing means. The toner is supplied to the development roller 10 by a supply roller 8 which rotates in the counter-clockwise direction as shown in FIG. 1. The development roller 10 rotate in the counter-clockwise direction as shown in FIG. 1 with holding the toner T, supplied by the supply roller 8, adhering thereon so as to carry the toner T to contact portion with the organic photoreceptor, thereby making the electrostatic latent image on the organic photoreceptor 1 visible.

The development roller 10 may be a roller made of a metallic pipe having a diameter from 16 mm to 24 mm, of which surface is treated by plating or blasting or which is formed on its peripheral surface with a conductive elastic layer made of NBR, SBR, EPDM, polyurethane rubber, or silicone rubber to have a volume resistivity of $10^4$ Ωcm to $10^8$ Ωcm and hardness of 40° to 70° (Asker A hardness). A developing bias voltage is applied from a power source (not shown) to the development roller via the shaft of the pipe or the center shaft thereof. The entire developing device composed of the development roller 10, the supply roller 8, and a toner regulating blade 9 is biased against the organic photoreceptor 1 by a biasing means such as a spring (not shown) with a pressure load of 20 to 100 gf/cm, preferably 25 to 70 gf/cm to have a nip width of 1 to 3 mm.

The regulating blade 9 is formed by pasting rubber tips on a SUS, a phosphor bronze, a rubber plate, a metal sheet. The regulating blade is biased against the development roller by a biasing means such as a spring (not shown) or the bounce itself as an elastic member with a linear load of 30 to 60 gf/cm to make the toner layer on the development roller to have the number of stories made up of toner particles becomes 2 or less.

In the contact developing method, the dark potential of the photoreceptor is preferably set in a range from −500 V to −700 V, the light potential thereof is preferably set in a range from −50 V to −150 V, and the developing bias is preferably set in a range from −100 V to −400 V, but not shown. The development roller and the supply roller are preferably in the same potential.

In the contact developing method, the peripheral velocity of the development roller which rotates in the counter-clockwise direction is preferably set to have a ratio of peripheral velocity from 1.2 to 2.5, preferably 1.5 to 2.2 relative to that of the organic photoreceptor which rotates in the clockwise direction. Therefore, even small-diameter toner particles are reliably subjected to the contact triboelectric charging with the organic photoreceptor.

Though there is no special limitation on the relation between the work functions of the regulating blade and the development roller and the work function of the toner, it is preferable that the work functions of the regulating blade and the development roller are each set to be smaller than the work function of the toner. In this case, the toner being in contact with the regulating blade is negatively charged, thereby achieving further uniform negative charge of the toner. Voltage may be applied to the regulating blade 9 to conduct charge injection to the toner, thereby controlling the charge of the toner.

Now, description will now be made as regard to the intermediate transfer medium in the image forming apparatus of the present invention. In FIG. 1, the intermediate transfer medium 5 is fed between the photoreceptor 1 and the back-up roller 7. During this, voltage is applied whereby the visible image on the photoreceptor 1 is transferred to the intermediate transfer medium to form a toner image on the intermediate transfer medium. Residual toner particles remaining on the photoreceptor after the transfer are removed by a cleaning blade 6 and electrostatic charge on the photoreceptor is erased by an erase lump, whereby the photoreceptor can be reusable. The image forming apparatus of the present invention can prevent inversely charged toner particles, thereby reducing the amount of toner particles remaining on the photoreceptor and thus reducing the size of a cleaning container.

In case that the intermediate transfer medium is a transfer drum or a transfer belt, voltage to be applied as a primary transfer voltage to the conductive layer of the intermediate transfer medium is preferably in a range from +250 V to +600 V. Voltage as a secondary transfer voltage to be applied for conducting the secondary transfer to the receiving medium such as a paper is preferably in a range from +400 V to +2800 V.

Description will now be made as regard to the case that the intermediate transfer medium is a transfer drum or a transfer belt. The transfer belt may be categorized into two types using substrates made of materials different from each other. One is a type comprising a film or a seamless belt made of resin having a transfer layer as an outer layer thereof and the other is a type comprising a substrate of elastic member having a transfer layer as an outer layer thereof. The transfer drum may be categorized into two types using substrates made of materials different from each other. One is a type corresponding to the photoreceptor comprising a rigid drum, for example a drum made of aluminum, and an organic photosensitive layer formed on the drum. That is, the transfer medium of this type comprising a rigid drum substrate made of aluminum or the like and an elastic transfer layer as an outer layer formed on the drum substrate. The other is a type corresponding to the photoreceptor, a so-called "elastic photoreceptor", i.e. comprising a belt-like substrate or an elastic substrate made of rubber and a photosensitive layer formed on the substrate. That is, the transfer medium of this type comprising a rigid drum substrate made of aluminum or the like and a transfer layer as an outer layer disposed directly or via a conductive intermediate layer on the drum substrate.

As the substrate, a known conductive or insulating substrate may be used. In case of the transfer belt, the volume resistivity is preferably in a range from $10^4$ to $10^{12}$ Ωcm, preferably $10^6$ to $10^{11}$ Ωcm. There are following two kinds according to the kind of substrate.

As for the material and the method for forming a film or a seamless belt, a material prepared by dispersing a conductive material such as conductive carbon black, conductive titanium oxide, conductive tin oxide, or conductive silica into an engineering plastic such as modified polyimide, thermosetting polyimide, polycarbonate, ethylene tetrafluoroethylene copolymer, poly vinylidene fluoride, or nylon alloy is extruded into a semi-conductive film substrate having a thickness of 50–500 μm and is made to be seamless substrate. Further, a surface protective layer for reducing the surface energy and preventing filming of toner is formed on the outer surface by coating fluorine to have a thickness of 5 to 50 μm. In this manner, the seamless belt is formed. The coating method may be a dip coating method, a ring coating method, a spray coating method, or another coating method. To prevent cracking at edges and elongation and serpentine motion of the transfer belt, tapes of PET film or ribs of polyurethane rubber having a thickness of 80 μm are attached to the edges of the transfer belt.

In case of the substrate made of a film sheet, the ends of the film sheet are ultrasonic-welded so as to form a belt. As concretely described, a conductive layer and an outer layer are formed on a sheet film before the ultrasonic welding so as to form a transfer belt having desired characteristics. More concretely, in case of using a polyethylene terephthalate film having a thickness of 60 to 150 μm as an insulating substrate, aluminum is deposited on the surface of the film, an intermediate conductive layer composed of a conductive material such as carbon black and resin is further coated if necessary, and a semi-conductive outer layer made of polyurethane resin, fluororesin, conductive material, fluorine fine particles having a surface resistivity higher than that of the intermediate layer is formed, thereby forming the transfer belt. In case that a resistance layer which does not need a large amount of heat for drying is allowed to be formed, the resistance layer may be formed after the ultrasonic welding of the film with aluminum deposition.

As for the material and the method for forming an elastic substrate of rubber or the like, a material prepared by dispersing the aforementioned conductive material into silicone rubber, polyurethane rubber, NBR (nitrile rubber), or EPDM (ethylene propylene rubber) is extruded into a semi-conductive rubber belt having a thickness of 0.8 to 2.0 mm. After that, the surface of the belt is processed by an abrasive such as a sand paper or a polisher to have desired surface roughness. Though this can be used without any additional layer, a surface protective layer may be further formed thereon similarly to the above case.

The transfer drum preferably has a volume resistivity of $10^4$ to $10^{12}$ Ωcm, preferably $10^7$ to $10^{11}$ Ωcm. As the method of forming a transfer drum, a conductive elastic substrate is prepared by forming a conductive intermediate layer of an elastic material on a metallic cylinder made of aluminum or the like. Further, a semi-conductive surface protective layer for reducing the surface energy and preventing filming of toner is made by, for example, coating fluorine to have a thickness of 5 to 50 μm.

As the method for forming a conductive elastic substrate, a conductive rubber material is prepared by mixing, kneading, and dispersing a conductive material such as carbon black, conductive titanium oxide, conductive tin oxide, or conductive silica into a rubber material such as silicone rubber, polyurethane rubber, NBR (nitrile rubber), or EPDM (ethylene propylene rubber), butadiene rubber, styrene-butadiene rubber, isoprene rubber, chloroprene rubber, butyl rubber, epichlorohydrin rubber, or fluororubber. The conductive rubber material is vulcanized onto an aluminum cylinder having a diameter of 90 to 180 mm and then ground to have a thickness of 0.8 to 6 mm and a volume resistivity of $10^4$ to $10^{10}$ Ωcm. After that, a semi-conductive outer layer made of polyurethane resin, fluororesin, conductive material, and fluorine fine particles is formed to have a thickness 15–40 μm, thereby forming a transfer drum having a desired volume resistivity of $10^7$ to $10^{11}$ Ωcm. At this point, the surface roughness is preferably 1 μmRa or less. As an alternative method, a semi-conductive tube made of fluororesin or the like is covered onto a conductive elastic substrate formed in the same manner as described above and is shrank by heat, thereby forming a transfer drum having a desired outer layer and a desired electrical resistivity.

FIG. 2 shows an example of the image forming apparatus of a non-contact developing type according to the present invention. In this method, the development roller 10 and the photoreceptor 1 confront each other to have a developing gap L therebetween. The developing gap is preferably in a range from 100 to 350 μm. As for the developing bias, the voltage of a direct current (DC) is preferably in a range from −200 to −500 V and an alternating current (AC) to be superimposed on the direct current is preferably in a range from 1.5 to 3.5 kHz with a P—P voltage in a range from 1000 to 1800 V, but not shown. In the non-contact developing type, the peripheral velocity of the development roller which rotates in the counter-clockwise direction is preferably set to have a ratio of peripheral velocity of 1.0 to 2.5, preferably 1.2 to 2.2 relative to that of the organic photoreceptor which rotates in the clockwise direction.

The development roller 10 rotates in the counter-clockwise direction as shown in FIG. 2 with holding the toner T, supplied by the supply roller 8, adhering thereon so as to carry the toner T to a confronting portion with the organic photoreceptor. By applying a bias voltage, composed of an alternating current superimposed on a direct current, to the confronting portion between the organic photoreceptor and the development roller, the toner T vibrates between the surface of the development roller and the surface of the organic photoreceptor to develop an image. In this case, toner particles adhere to the photoreceptor during the vibration of the toner T between the surface of the development roller and the surface of the organic photoreceptor, whereby toner particles of small-particle diameter which are excessively negatively charged are controlled to have stable charge, thereby ensuring the stable amount of developing toner particles.

The intermediate transfer medium is fed between the photoreceptor 1 with a visible image and the backup roller 7. During this, the pressing load of the intermediate transfer medium on the photoreceptor 1 by the backup roller is preferably in a range from 25 to 60 gf/cm, preferably from 35 to 50 gf/cm which is greater than that of the contact developing type by about thirty percent. This ensures the contact between the toner particles and the photoreceptor, whereby the toner particles can be controlled to have suitable amount of charge so as to improve the transfer efficiency.

The other items of the image forming apparatus of the non-contact developing type are the same as those of the image forming apparatus of the contact developing type.

Figure 3:
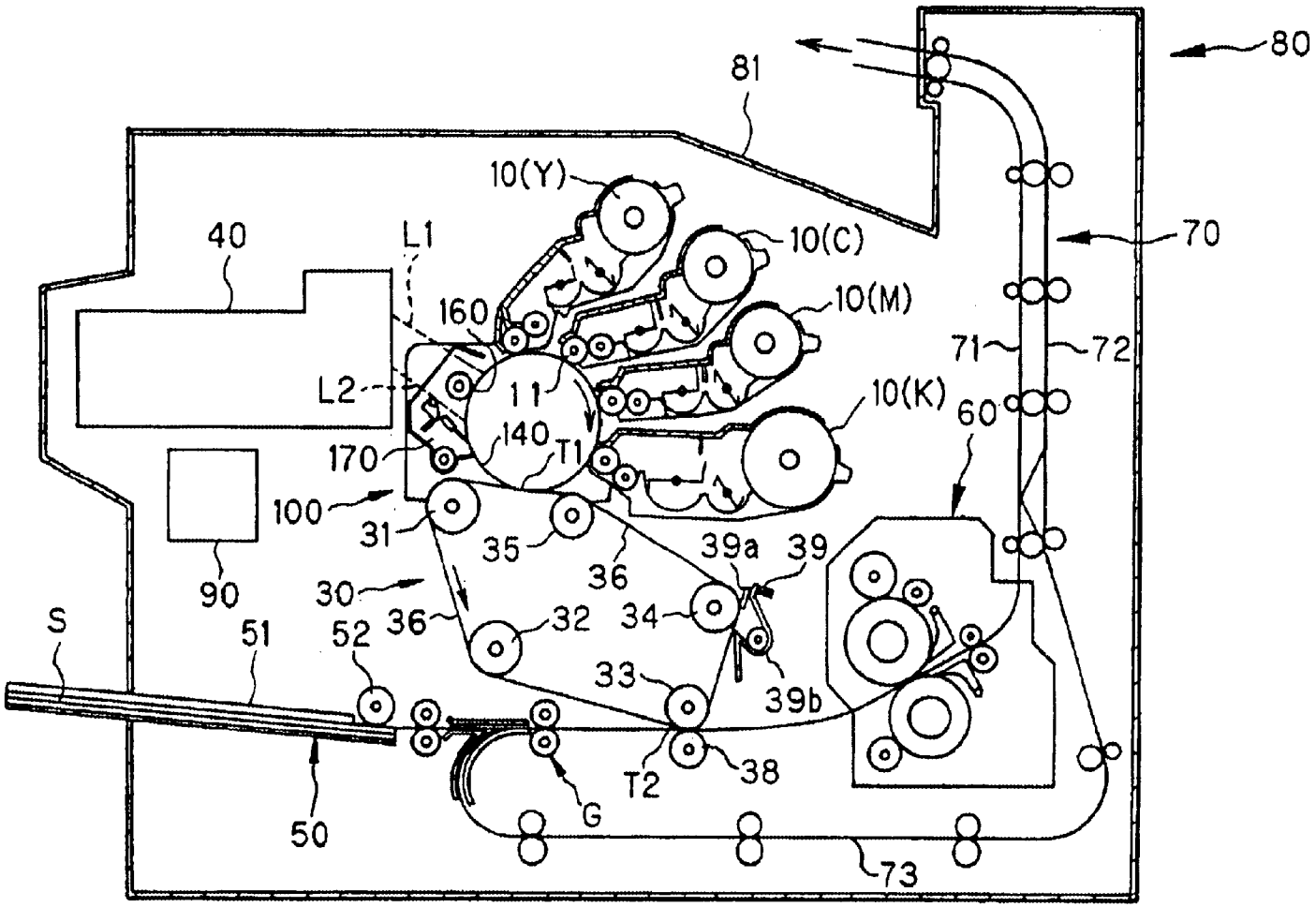
FIG. 3 is an explanatory illustration showing an example of a full color printer according to the image forming apparatus of the present invention.
Figure 4:
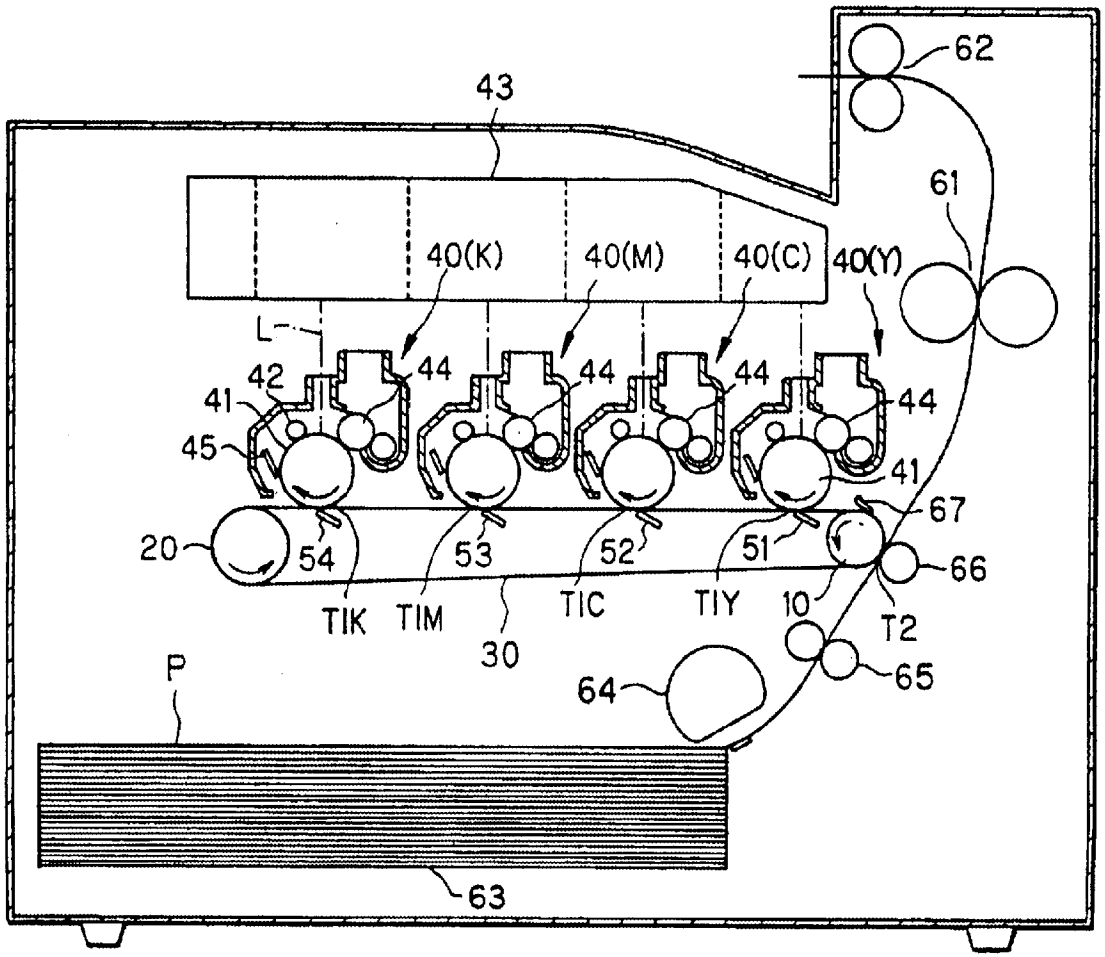
FIG. 4 is an explanatory illustration showing an example of a full-color printer of tandem type according to the image forming apparatus of the present invention.

By combining developing devices of conducting developing process as shown in FIG. 1 or FIG. 2 with respective four color toners (developers) of yellow Y, cyan C, magenta M, and black K and the photoreceptor, an apparatus capable of forming a full color image can be provided. FIG. 3 and FIG. 4 show examples of a full color image forming apparatus.

In FIG. 3, a numeral 100 designates a latent image carrier cartridge in which a latent image carrier unit is assembled. In this example, the photoreceptor cartridge is provided so that the photoreceptor and a developing unit can be separately installed. A negative chargeable photoreceptor (latent image carrier) 140 having a work function satisfying the relation of the present invention is rotated in a direction of arrow by a suitable driving means (not shown). Arranged around the photoreceptor 140 along the rotational direction are a charging roller 160 as the charging means, developing devices 10 (Y, M, C, K) as the developing means, an intermediate transfer device 30, and a cleaning means 170.

The charging roller 160 is in contact with the outer surface of the photoreceptor 140 to uniformly charge the outer surface of the same. The uniformly charged outer surface of the photoreceptor 140 is exposed to selective light L1 corresponding to desired image information by an exposing unit 40, thereby forming an electrostatic latent image on the photoreceptor 140. The electrostatic latent image is developed with developers by the developing devices 10.

The developing devices 10 are a developing device 10Y for yellow, a developing device 10M for magenta, a developing device 10C for cyan, and a developing device 10K for black. These developing devices 10Y, 10C, 10M, 10K can swing so that the development roller (developer carrier) 11 of only one of the developing devices is selectively in press contact with the photoreceptor 140. These developing devices 10 hold negatively charged toners, having work function satisfying the relation of the present invention relative to the work function of the photoreceptor, on the respective development rollers. Each developing device 10 supplies either one of toners of yellow Y, magenta M, cyan C, and black K to the surface of the photoreceptor 140, thereby developing the electrostatic latent image on the photoreceptor 140. Each development roller 11 is composed of a hard roller, for example a metallic roller which is processed to have rough surface.

The developed toner image is transferred to an intermediate transfer belt (intermediate transfer medium) 36 of the intermediate transfer device 30. The cleaning means 170 comprises a cleaner blade for scraping off toner particles T adhering to the outer surface of the photoreceptor 140 after the transfer and a toner receiving element for receiving the toner particles scrapped by the cleaner blade.

The intermediate transfer device 30 comprises a driving roller 31, four driven rollers 32, 33, 34, 35, and the endless intermediate transfer belt 36 wound onto and tightly held by these rollers. The driven roller 35 is disposed at such a position that the intermediate transfer belt 36 is in press contact with the photoreceptor 140 by the tension itself between the driving roller 31 and the driven roller 35, thereby providing a primary transfer portion T1 at the press contact portion between the photoreceptor 140 and the intermediate transfer belt 36. The driven roller 35 is arranged at an upstream of the circulating direction of the intermediate transfer belt and near the primary transfer portion T1.

On the driving roller 31, an electrode roller (not shown) is disposed via the intermediate transfer belt 36. A primary transfer voltage is applied to a conductive layer of the intermediate transfer belt 36 via the electrode roller. The driven roller 32 is a tension roller for biasing the intermediate transfer belt 36 in the tensioning direction by a biasing means (not shown). The driven roller 33 is a backup roller for providing a secondary transfer portion T2. A secondary transfer roller 38 is disposed to confront the backup roller 33 via the intermediate transfer belt 36. A secondary transfer voltage is applied to the secondary transfer roller. The secondary transfer roller can move to separate from or to come in contact with the intermediate transfer belt 36 by a sifting mechanism (not shown). The driven roller 34 is a backup roller for a belt cleaner 39. The belt cleaner 39 can move to separate from or to come in contact with the intermediate transfer belt 36 by a shifting mechanism (not shown).

The intermediate transfer belt 36 is a dual-layer belt comprising the conductive layer and a resistive layer formed on the conductive layer, the resistive layer being brought in press contact with the photoreceptor 140. The conductive layer is formed on an insulating substrate made of synthetic resin. The primary transfer voltage is applied to the conductive layer through the electrode roller as mentioned above. The resistive layer is removed in a band shape along the side edge of the belt so that the corresponding portion of the conductive layer is exposed in the band shape. The electrode roller is arranged in contact with the exposed portion of the conductive layer.

In the circulating movement of the intermediate transfer belt 36, the toner image on the photoreceptor 140 is transferred onto the intermediate transfer belt 36 at the primary transfer portion T1, the toner image transferred on the intermediate transfer belt 36 is transferred to a sheet (recording medium) S such as a paper supplied between the secondary transfer roller 38 and the intermediate transfer belt at the secondary transfer portion T2. The sheet S is fed from a sheet feeder 50 and is supplied to the secondary transfer portion T2 at a predetermined timing by a pair of gate rollers G. Numeral 51 designates a sheet cassette and 52 designates a pickup roller.

The toner image is fixed by a fixing device 60 and is discharged through a discharge path 70 onto a sheet tray 81 formed on a casing 80 of the apparatus. The image forming apparatus of this example has two separate discharge paths 71, 72 as the discharge path 70. The sheet after the fixing device 60 is discharged through either one of the discharge paths 71, 72. The discharge paths 71, 72 have a switchback path through which a sheet passing through the discharge path 71 or 72 is returned and fed again through a return roller 73 to the secondary transfer portion T2 in case of forming images on both sides of the sheet.

The actions of the image forming apparatus as a whole will be summarized as follows:

(1) As a printing command (image forming signal) is inputted into a control unit 90 of the image forming apparatus from a host computer (personal computer) (not shown) or the like, the photoreceptor 140, the respective rollers 11 of the developing devices 10, and the intermediate transfer belt 36 are driven to rotate.

(2) The outer surface of the photoreceptor 140 is uniformly charged by the charging roller 160.

(3) The outer surface of the photoreceptor 140 is exposed to selective light L1 corresponding to image information for a first color (e.g. yellow) by the exposure unit 40, thereby forming an electrostatic latent image for yellow.

(4) Only the development roller of the developing device 10Y for yellow as the first color is brought in contact with the photoreceptor 140 so as to develop the aforementioned electrostatic latent image, thereby forming a toner image of yellow as the first color on the photoreceptor 140.

(5) The primary transfer voltage of the polarity opposite to the polarity of the toner is applied to the intermediate transfer belt 36, thereby transferring the toner image formed on the photoreceptor 140 onto the intermediate transfer belt 36 at the primary transfer portion T1. At this point, the secondary transfer roller 38 and the belt cleaner 39 are separate from the intermediate transfer belt 36.

(6) After residual toner particles remaining on the photoreceptor 140 are removed by the cleaning means 170, the charge on the photoreceptor 140 is removed by removing light L2 from a removing means 41.

(7) The above processes (2)–(6) are repeated as necessary. That is, according to the printing command, the processes are repeated for the second color, the third color, and the forth color and the toner images corresponding to the printing command are superposed on each other on the intermediate transfer belt 36.

(8) A sheet S is fed from the sheet feeder 50 at a predetermined timing, the toner image (a full color image formed by superposing the four toner colors) on the intermediate transfer belt 36 is transferred onto the sheet S with the secondary transfer roller 38 immediately before or after an end of the sheet S reaches the secondary transfer portion T2 (namely, at a timing as to transfer the toner image on the intermediate transfer belt 36 onto a desired position of the sheet S). The belt cleaner 39 is brought in contact with the intermediate transfer belt 36 to remove toner particles remaining on the intermediate transfer belt 36 after the secondary transfer.

(9) The sheet S passes through the fixing device 60 whereby the toner image on the sheet S is fixed. After that, the sheet S is carried toward a predetermined position (toward the sheet tray 81 in case of single-side printing, or toward the return roller 73 via the switchback path 71 or 72 in case of dual-side printing).

Though the image forming apparatus according to the present invention employs such a developing method that the development rollers 11 and the intermediate transfer medium 36 are in contact with the photoreceptor 140, the image forming apparatus according to the present invention may employ a non-contact jumping developing method.

A schematic front view of a full color printer of the tandem type to be used in the present invention is shown in FIG. 4. In this case, the photoreceptor and the developing unit are combined in one unit, that is, can be installed as a process cartridge to the apparatus. Though this example is of a contact development type, the apparatus may be of a non-contact development type.

The image forming apparatus comprises an intermediate transfer belt 30 which is wound onto and tightly held by only two rollers, i.e. a driving roller 10 and a driven roller 20, and is driven to circulate in a direction of arrow (the counter-clockwise direction), and a plurality of (four) unicolor toner image forming means 40 (Y, C, M, K) arranged along the intermediate transfer belt 30. Respective toner images formed by the unicolor toner image forming means 40 are sequentially primary-transferred to the intermediate transfer belt 30 by transfer means 51, 52, 53, 54, respectively. The respective primary transfer portions are indicated with T1Y, T1C, T1M, and T1K.

As the unicolor toner image forming means, there are 40(Y) for yellow, 40(M) for magenta, 40(C) for cyan, and 40(K) for black. Each of these unicolor toner image forming means 40 (Y, C, M, K) comprises a photoreceptor 41 having a photosensitive layer on its outer surface, a charging roller 42 as charging means for uniformly charging the outer surface of the photoreceptor 41, an exposure means 43 for selectively exposing the outer surface of the photoreceptor 41, uniformly charged by the charging roller 42, so as to form an electrostatic latent image, a development roller 44 for developing the electrostatic latent image, formed by the exposure means 43, with developer or toner so as to form a visible image (toner image), and a cleaning blade 45 as cleaning means for removing toner particles remaining on the surface of the photoreceptor 41 after the toner image is transferred to the intermediate transfer belt 30 as the primary transfer medium.

These unicolor toner image forming means 40 (Y, C, M, K) are arranged on a loose side of the intermediate transfer belt 30. Toner images are sequentially transferred to the intermediate transfer belt 30 and sequentially superposed on each other on the intermediate transfer belt 30 so as to form a full color toner image. The full color toner image is secondary-transferred to a recording medium P such as a paper at a secondary transfer portion T2 and is fixed by passing the recording medium P between a pair of fixing rollers 61. After that, the recording medium P is discharged by a pair of discharge rollers 62 to a predetermine location (an output sheet tray (not shown)). Numeral 63 designates a sheet cassette for holding recording media P in a piled state, 64 designates a pickup roller for feeding the recording media P one by one from the sheet cassette 63, 65 designates a pair of gate rollers for defining the feeding timing of the recording medium P from the sheet cassette 63.

Numeral 66 designate a secondary transfer roller as secondary transfer means for cooperating with the intermediate transfer belt 30 to provide the secondary transfer portion T2 therebetween, 67 designates a cleaning blade as cleaning means for removing toner particles remaining on the surface of the intermediate transfer belt 30 after the secondary transfer. The cleaning blade 67 is in contact with the intermediate transfer belt 30 at a wrapping portion on the driving roller 10 not the driven roller 20.

Hereinafter, the present invention will be described in detail with reference to specific examples. Product examples of the toner, the organic photoreceptor, the development roller, and the intermediate transfer medium employed in the specific examples will be explained below.

PRODUCTION EXAMPLE OF TONER 1

A monomer mixture composed of 80 parts by weight of styrene monomer, 20 parts by weight of butyl acrylate, and 5 parts by weight of acryl acid was added into a water soluble mixture composed of: 105 parts by weight of water, 1 part by weight of nonionic emulsifier, 1.5 parts by weight of anion emulsifier, and 0.55 parts by weight of potassium persulfate and was agitated and polymerized in nitrogen gas atmosphere at a temperature of 70° C. for 8 hours. By cooling after polymerization reaction, milky white resin emulsion having a particle size of 0.25$\mu$m was obtained. Then, a mixture composed of 200 parts by weight of resin emulsion obtained above, 20 parts by weight of polyethylene wax emulsion (available from Sanyo Chemical Industries, Ltd.), and 7 parts by weight of Phthalocyanine Blue was dispersed into water containing 0.2 parts by weight of dodecyl benzene sulfonic acid sodium as a surface active agent, and was adjusted to have pH of 5.5 by adding diethyl amine. After that, electrolyte aluminum sulfate was added in an amount of 0.3 parts by weight with agitation and subsequently agitated at a high speed and thus dispersed by using a TK homo mixer. Further, 40 parts by weight of styrene monomer, 10 parts by weight of butyl acrylate, and 5 parts by weight of zinc salicylate were added with 40 parts by weight of water, agitated in nitrogen gas atmosphere, and heated at a temperature of 90° C. in the same manner. By adding hydrogen peroxide, polymerization was conducted for 5 hours to grow up particles. After the polymerization, the pH was adjusted to be 5 or more while the temperature was increased to 95° C. and then maintained for 5 hours in order to improve the bonding strength of associated particles. The obtained particles were washed with water and dried under vacuum at a temperature of 45° C. for 10 hours. A cyan toner was obtained in this manner and had a mean particle diameter of 6.8 $\mu$m based on the number and a degree of circularity of 0.980. To the obtained toner, as fluidity improving agents, hydrophobic silica having a mean particle diameter of about 12 nm was added in an amount of 1 weight %, hydrophobic silica having a mean particle diameter of about 40 nm was added in an amount of 0.7 weight %, hydrophobic titanium oxide having a mean particle diameter of about 20 nm was added in an amount of 0.5 weight %, and aluminum oxide having a mean particle diameter of about 13 nm was added in an amount of 0.2 weight % and they were mixed, thereby producing a toner 1. The work function of the obtained toner was measured by using the commercial surface analyzer (AC-2, produced by Riken Keiki Co., Ltd) with radiation amount of 500 nW and the measured value was 5.55 eV.

PRODUCTION EXAMPLE OF TONER 2

A magenta toner 2 was obtained in the same manner as the above toner 1 except that Quinacridon was used instead of Phthalocyanine Blue as the pigment and that the temperature for improving the association and the film bonding strength of secondary particles was still kept at 90° C. The degree of circularity of the magenta toner was 0.972, the work function of the same was 5.64 eV, and the mean particle diameter of the same was 6.9 $\mu$m.

PRODUCTION EXAMPLES OF TONER 3, 4

A yellow toner 3 and a black toner 4 were obtained by polymerization and addition of fluidity improving agents, in the same manner as the above toner 2 except that Pigment Yellow 180 and Carbon Black were used as the pigment, respectively. In this manner, a yellow toner 3 having a degree of circularity of 0.972, a work function of 5.60 eV, and a mean particle diameter of 7.0 $\mu$m and a black toner 4 having a degree of circularity of 0.973, a work function of 5.49 eV, and a mean particle diameter of 6.9 $\mu$m were obtained.

PRODUCTION EXAMPLE OF TONER 5

100 parts by weight of a mixture (available from Sanyo Chemical Industries, Ltd.) which was 50:50 (by weight) of polycondensate polyester, composed of aromatic di-carboxylic acid and bisphenol A of alkylene ether, and partially crosslinked compound of the polycondensate polyester by polyvalent metal, 5 parts by weight of Phthalocyanine Blue as a cyan pigment, 1 part by weight of polypropylene having a melting point of 152° C. and a Mw of 4000 as a release agent, and 4 parts by weight of metal complex compound of salicylic acid E-81 (available from Orient Chemical Industries, Ltd.) as a charge control agent were uniformly mixed by using a Henschel mixer, kneaded by a twin-shaft extruder with an internal temperature of 130° C., and then cooled. The cooled substance was roughly pulverized into pieces of 2 square mm or less and then pulverized into fine particles by a jet mill. The fine particles were classified by a rotary classifier, thereby obtaining a classified toner having a mean particle diameter of 6.2 $\mu$m and a degree of circularity of 0.905. Subsequently, the classified toner was surface-treated by adding hydrophobic silica (mean particle diameter: 7 nm, specific surface: 250 $m^2/g$) in an amount of 0.2% by weight, after that, were partially spheroidized by using a hot air spheroidizing apparatus Surfusing System at a treatment temperature of 200° C. for improving the circularity, and were classified in the same manner, thereby forming toner mother particles having a mean particle diameter of 6.3 $\mu$m and a degree of circularity of 0.940. Fluidity improving agents were added and mixed to the toner mother particles in the same manner as the toner 1, thereby obtaining a toner 5. The work function of the obtained toner was measured in the same manner and the result of the measurement was 5.43 eV.

PRODUCTION EXAMPLES OF TONER 6, 7, 8)

A magenta toner 6 was obtained by pulverization, classification, heat treatment, re-classification, and surface-treatment in the same manner as the above toner 5 except that 6B of naphthol AS series was used as the pigment. The work function of the obtained toner 6 was measured in the same manner and the result of the measurement was 5.55 eV. In the same manner, a toner 7 (Pigment Yellow 180 was used for this yellow toner), and a toner 8 (Carbon Black was used for this black toner) were obtained. The mean particle diameters and the degrees of circularity of the obtained toners were substantially the same as those of the toner 6. The work functions of the respective toners were 5.58 eV (yellow), and 5.64 eV (black).

PRODUCTION EXAMPLE OF ORGANIC PHOTORECEPTOR (OPC 1)

An aluminum pipe of 85.5 mm in diameter was used as a conductive substrate. A coating liquid was prepared by dissolving and dispersing 6 parts by weight of alcohol dissolvable nylon [available from Toray Industries, Inc. (CM8000)] and 4 parts by weight of titanium oxide fine particles treated with aminosilane into 100 parts by weight of methanol. The coating liquid was coated on the peripheral surface of the conductive substrate by the ring coating method and was dried at a temperature 100° C. for 40 minutes, thereby forming an undercoat layer having a thickness of 1.5 to 2 $\mu$m.

A pigment dispersed liquid was prepared by dispersing 1 part by weight of titanyl phthalocyanine pigment as a charge generation pigment, 1 part by weight of butyral resin [BX-1, available from Sekisui Chemical Co., Ltd.], and 100 parts by weight of dichloroethane for 8 hours by a sand mill with glass beads of $\phi$1 mm. The pigment dispersed liquid was applied on the undercoat layer and was dried at a temperature of 80° C. for 20 minutes, thereby forming a charge generation layer having a thickness of 0.3 $\mu$m.

A liquid was prepared by dissolving 40 parts by weight of charge transport material of a benzizine compound having the following structural formula (1) and 60 parts by weight of polycarbonate resin (Panlite TS, available from Teijin Chemicals Ltd.) into 400 parts by weight of toluene. The liquid was applied on the charge generation layer by the dip coating to have a thickness of 22 $\mu$m when dried, thereby forming a charge transport layer. In this manner, an organic photoreceptor (OPC 1) having a double-layer type photosensitive layer (so called a layered photoreceptor) was obtained.

A test piece was made by cutting a part of the obtained organic photoreceptor and was measured by using the commercial surface analyzer (AC-2, produced by Riken Keiki Co., Ltd) with radiation amount of 500 nW. The measured work function was 5.72 eV.

PRODUCTION EXAMPLES OF ORGANIC PHOTORECEPTOR (OPC 2, 3, 4)

Organic photoreceptors were obtained in the same manner as the above organic photoreceptor (OPC 1) except that the charge generation pigment and the charge transport material were selected as shown in FIG. 5. The obtained organic photoreceptors were partially cut for measuring the work functions and the results are shown in FIG. 5. The structural formulas (2), (3), (4) of the used charge transport materials are as follows.

Structural Formula (1) of Charge Transport Material:

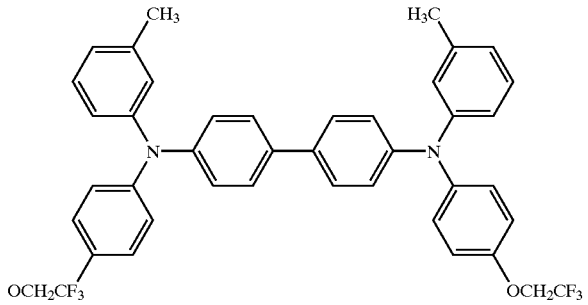

Structural Formula (2) of Charge Transport Material:

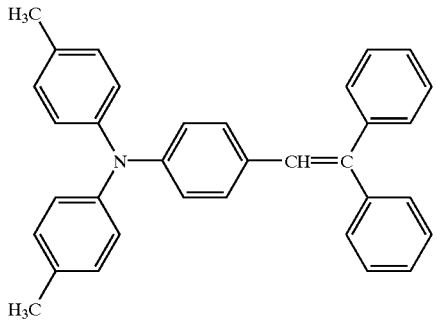

Structural Formula (3) of Charge Transport Material:

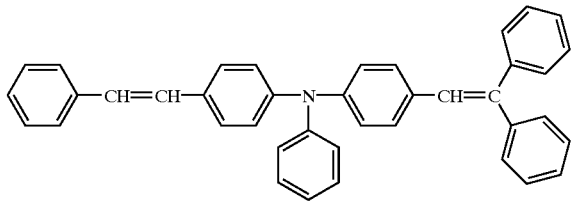

Structural Formula (4) of Charge Transport Material:

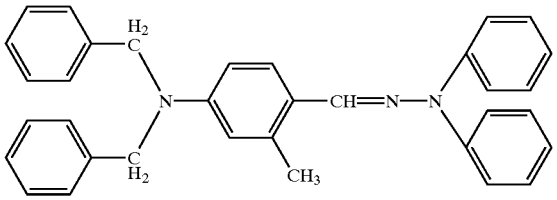

PRODUCT EXAMPLES OF ORGANIC PHOTORECEPTOR (OPC 5, 6)

Organic photoreceptors (OPC 5, 6) were obtained in the same manner as the above organic photoreceptors (OPC 1, 2) except that a nickel electroforming seamless pipe having a thickness 40 μm and a diameter of 85.5 mm instead of the aluminum pipe. The measured work functions of these organic photoreceptors were 5.72 eV and 5.47 eV, respectively.

PRODUCT EXAMPLE OF DEVELOPMENT ROLLER

An aluminum pipe of 18 mm in diameter was surfaced with nickel plating (thickness: 23 μm). The surface roughness (Ra) was 4 μm. The result of measurement, the work function of the surface of this development roller was 4.58 eV.

PRODUCT EXAMPLE OF REGULATING BLADE

Conductive polyurethane rubber tips of 1.5 mm in thickness were attached to a SUS plate of 80 μm in thickness by conductive adhesive. The work function of the polyurethane portion was 5 eV.

PRODUCT EXAMPLE OF INTERMEDIATE TRANSFER BELT (1)

A uniformly dispersed liquid composed of 30 parts by weight of vinyl chloride-vinyl acetate copolymer, 10 parts by weight of conductive carbon black, and 70 parts by weight of methyl alcohol was applied on a polyethylene terephthalate resin film of 130 μm in thickness with aluminum deposited thereon by the roll coating method to have a thickness of 20 μm and dried to form an intermediate conductive layer. Then, a coating liquid made by mixing and dispersing the following components: 55 parts by weight of nonionic aqueous polyurethane resin (solid ratio: 62 wt. %), 11.6 parts by weight of polytetrafluoroethylene emulsion resin (solid ratio: 60 wt. %), 5 parts by weight of conductive titanium oxide, 25 parts by weight of conductive tin oxide, 34 parts by weight of polytetrafluoroethylene fine particles (max particle diameter: 0.3 μm or less), 5 parts by weight of polyethylene emulsion (solid ratio: 35 wt. %), and 20 parts by weight of deionized water, was coated on the intermediate conductive layer by the roll coating method to have a thickness of 10 μm and dried in the same manner so as to form a transfer layer. The obtained coated sheet was cut to have a length of 540 mm. The ends of the cut piece are superposed on each other with the coated surface outward and welded by ultrasonic, thereby making an intermediate transfer belt. The volume resistivity of this transfer belt was $8.8\times10^{9}$ Ωcm. The work function was 5.69 eV and the normalized photoelectron yield was 7.39.

PRODUCT EXAMPLE OF INTERMEDIATE TRANSFER BELT (2)

85 parts by weight of polyethylene terephthalate, 15 parts by weight of polycarbonate, and 15 parts by weight of acetylene black were previously mixed in atmosphere of nitrogen gas by a mixer. The obtained mixture was kneaded also in atmosphere of nitrogen gas by a twin-shaft extruder to have a pellet. The pellet was extruded by a single shaft extruder with an annular die into a tubular film having an outer diameter of 160 mm and a thickness of 160 μm at a temperature of 260° C. Then, the hot tube obtained by the extrusion was set to fix its inner diameter by a cool inside mandrel supported coaxially with the annular die. By cooling and solidifying the tube in this state, a seamless tube was made. The seamless tube was cut into a predetermined size, thereby obtaining a seamless transfer belt having an outer diameter of 172 mm, a width of 383 mm, and a thickness of 150 μm. The volume resistivity of this transfer belt was $3.2\times10^{8}$ Ωcm. The work function was 5.19 eV and the normalization photoelectron yield was 10.88.

EXAMPLE 1

By using the organic photoreceptor (OPC 2) into a four-cycle full-color printer of an intermediate transfer medium type as shown in FIG. 3 provided with the aforementioned development rollers and the aforementioned regulating blades, a combination of the toner 1 obtained in the above and the intermediate transfer belt (1) obtained in the above was employed to make image forming tests of the non-contact single-component developing method.

For tests, the peripheral velocity of the organic photoreceptor was set to 180 mm/s. The development rollers are set to have a peripheral velocity ratio of 2 relative to the organic photoreceptor. The peripheral velocity difference between the organic photoreceptor and the transfer belt as the intermediate transfer medium is set such that the rotation of the transfer belt 3 is faster than the organic photoreceptor by 3%. Since some previous experiments showed flush in transferred images with the ratio exceeding 3%, the upper limit was set to 3%. The aforementioned regulating condition of the toner regulating blade was changed to have a carrying amount of toner on the development roller from 0.285 mg/cm$^2$ to 0.421 mg/cm$^2$. After an original image of 5% duty was successively printed on two sheets of paper under the condition, the charging property of the toner on the development roller was measured by a charge distribution measuring system (E-SPART III available from Hosokawa Micron Corporation). The results of the measurements for the charging property are shown in FIG. 6.

A gap between the development roller and the photoreceptor was set to 210 μm (the space was adjusted by a gap roller). A developing bias was applied under condition that an AC to be superimposed on a DC developing bias of −200 V was set to have a frequency of 2.5 kHz and a P—P voltage of 1400 V. The development roller and the supply roller were set to have the same potential.

Solid image was printed by the four-cycle full-color printer shown in FIG. 3. The densities of the solid image portions, the degree of fog toner on the photoreceptor, and the degree of reverse transfer toner were measured. The transfer voltage applied to the primary transfer portion was +350 V.

The densities of solid portions of the image were measured by Macbeth reflection densitometer and the respective degrees of toner were measured by the tape transfer method that was a method comprising attaching a commercial mending tape, available from Sumitomo 3M Ltd., onto toner on the photoreceptor to peel the toner particles, attaching the tape on a white plain paper, measuring the reflection density of the tape, and obtaining the difference by subtracting the reflection density of the tape from the measured value. The transfer efficiency was measured from the amounts of toner particles on the photoreceptor before and after the transfer. It should be noted that the tape transfer method is a method comprising attaching a tape onto toner, measuring a difference between the weight of the tape before and after the attachment, and calculating the amount of toner (mg/cm$^2$). The results are shown in FIG. 7.

Figure 8:
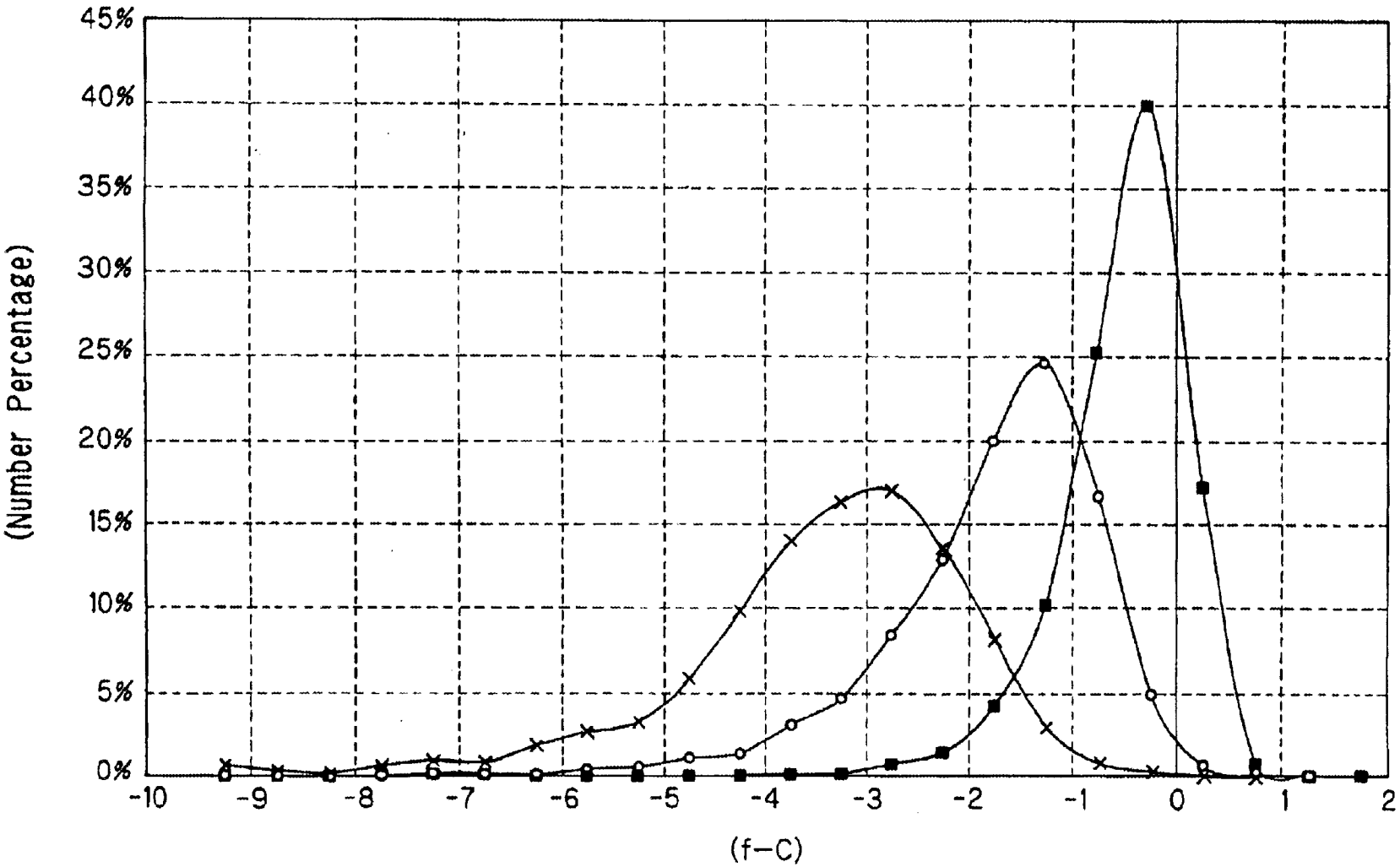
FIG. 8 is a diagram showing a charge distribution characteristic of toner particles used in the image forming apparatus of the present invention.

As for the toner layer adhering to the surface of the development roller after passing the toner regulating blade, the charge distribution characteristics in a case of using the toner 1 was measured by the aforementioned charge distribution measuring system. The result is shown in FIG. 8. The ordinate shows the number percentage and the abscissa shows the amount of charge (Femto-Coulomb).

In FIG. 8, a solid line with mark x indicates a case of a toner with carrying amount of 0.295 mg/cm$^2$, a solid line with mark ○ indicates a case of a toner with carrying amount of 0.340 mg/cm$^2$, and a solid line with mark ■ indicates a case of a toner with carrying amount of 0.431 mg/cm$^2$. The mean particle diameter of the toner is 6.8 $\mu$m. It was found from the results shown in FIG. 6, FIG. 7, and FIG. 8 that the transfer with higher transfer efficiency, no or little fog, and significantly reduced reverse transfer toner can be achieved by setting the carrying amount to satisfy the following relational expression:

$$\text{Carrying amount } A=0.058D\pm0.1$$

wherein D is the value of the mean particle diameter ($\mu$m).

With the substitution of the value 6.8 of the mean particle diameter of the example toner 1, the lower limit of the above relational expression is 0.294 mg/cm$^2$ and the upper limit of the above relational expression is 0.494 mg/cm$^2$. With the carrying amount of 0.294 mg/cm$^2$ or less, the concentration of toner thin layer was rough so that the amount of charge should be too high and, in addition, the amount of toner to be supplied was insufficient for development of solid images. As a result of this, the densities of solid image portions were low. With the carrying amount close to 0.494 mg/cm$^2$, the densities of solid image portions were sufficient. However, the inversely charged toner was increased, thus producing flush around the solid image portions and tending to increase the fog and reverse transfer toner. Accordingly, the amount of cleaning toner also tended to increase in case of continuous printing.

The following examples 2 through 5 are embodiments according to claim 1.

EXAMPLE 2

By using four-cycle full-color printers of an intermediate transfer medium type as shown in FIG. 3 according to the non-contact developing process in which combinations of the toner 1 and the organic photoreceptors (OPC 1, OPC 2, OPC 3, OPC 4) obtained in the above were set in the respective cyan developing cartridges, images were formed according to non-contact single-component developing method shown in FIG. 2. Though the condition for forming images was the same as those of Example 1, the toner carrying amount was 0.340 mg/cm$^2$ and the primary transfer voltages were +100 V and +300 V. Under the conditions, the transfer efficiencies were measured. The results are shown in FIG. 9 and FIG. 10.

Figure 9:
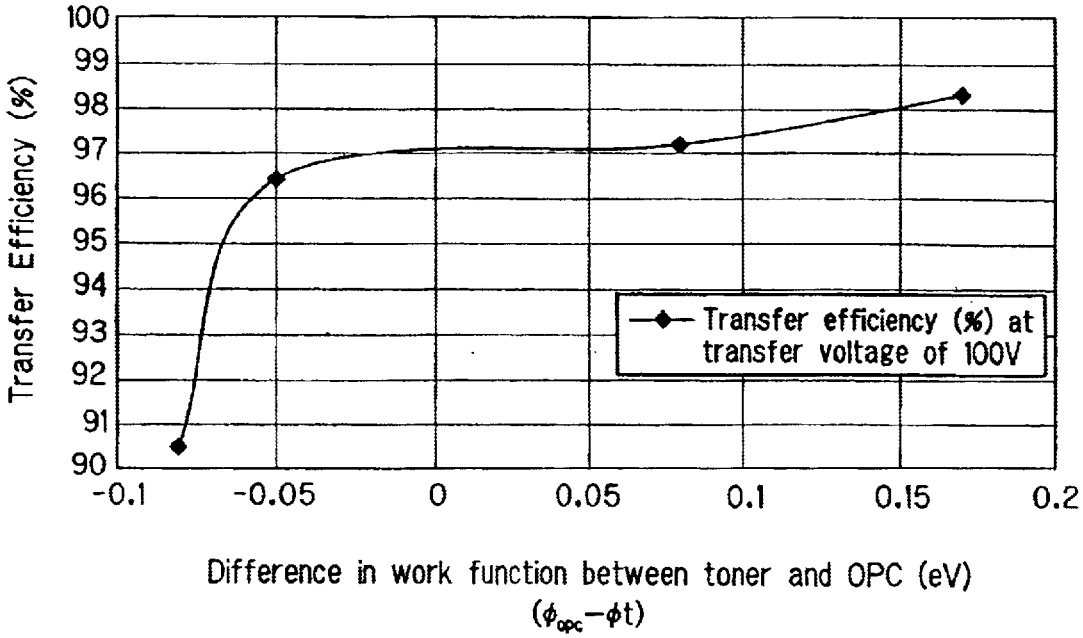
Figure 10:
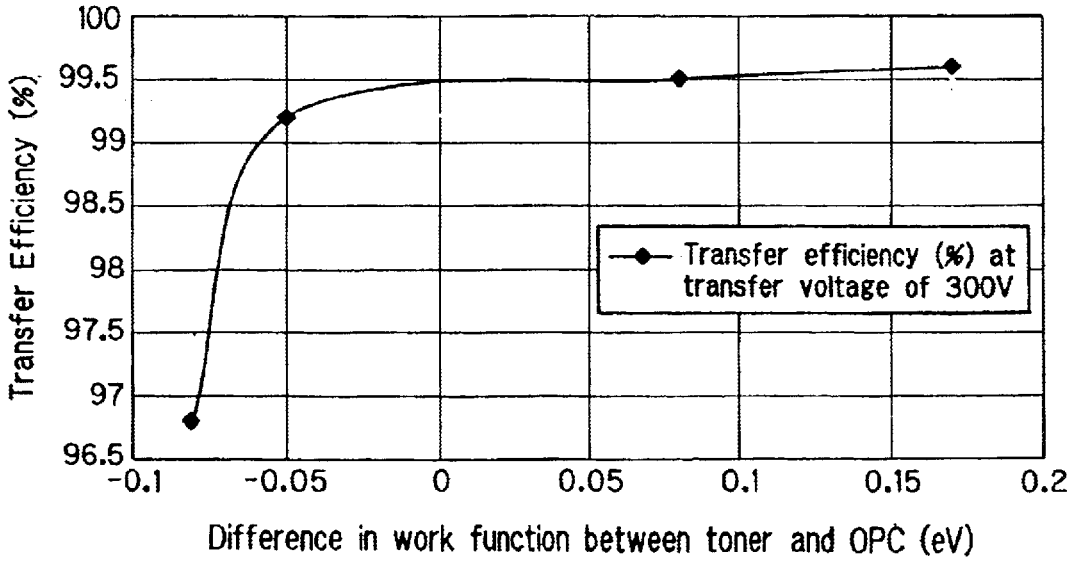

It is found from the results shown in FIG. 9 and FIG. 10 that the transfer efficiency is improved by setting the work function ($\Phi_{OPC}$) of the organic photoreceptor to be larger than the work function ($\Phi_t$) of the toner. This is noticeable in case of lower primary transfer voltage of +100 V i.e. low. In case that the primary transfer voltage is set to +300 V, the improvement of transfer efficiency is smaller. When the difference in work function ($\Phi_{OPC}-\Phi_t$) was larger than −0.05 eV i.e. substantially the same or larger, the transfer efficiency of toner from the organic photoreceptor to the intermediate transfer medium was improved. Since the toner is regulated in thin layer, the toner tends to be excessively charged. As the toner comes in contact with the organic photoreceptor, movement of charge from the toner to the photoreceptor is caused. As a result, the amount of charge of the toner is lowered to an amount of charge suitable for facilitating the transfer of toner. This may be the reason that the transfer efficiency is improved. To the contrary, in case of setting the work function of the organic photoreceptor to be smaller than that of toner, the amount of charge of the toner may be increased not reduced so that the transfer efficiency was reduced.

EXAMPLE 3

By using four-cycle full-color printers of the intermediate transfer medium type as shown in FIG. 3 according to the non-contact developing process in which combinations of the toner 1 through the toner 4, the organic photoreceptors (OPC 1, OPC 2), and the transfer belt (1) obtained in the above were employed and cartridges containing the respective color toners therein were installed, images were formed according to non-contact single-component developing method similarly to Example 1. The toner carrying amounts of the respective color toners were set to be substantially equal to the other in a range from 0.34 mg/cm$^2$ to 0.35 mg/cm$^2$. It should be noted that any toner has a carrying amount A (g/cm$^2$) within a range of A=0.058±0.1. The voltage at the primary transfer portion was +300 V. Successive image printing was conducted as follows. After a character image corresponding to color original containing 5% each color was successively printed on 10000 sheets of paper, the total amount of four color toners collected by cleaning the photoreceptor and the intermediate transfer belt was measured. The results are shown in FIG. 11.

It is found from the results shown in FIG. 11 that the cleaning amount of toner is reduced by setting the work function of the organic photoreceptor to be larger than the work function of the toner. With the primary transfer voltage of +100 V, the difference in cleaning amount was increased to 11 g which was nearly doubled.

EXAMPLE 4

By using four-cycle full-color printers of the intermediate transfer medium type as shown in FIG. 3 according to the contact developing process shown in FIG. 1 in which combinations of the toner 5 through the toner 8, the organic photoreceptors (OPC 5, OPC 6) which were elastic photoreceptors, and the transfer belt (1) obtained in the above were set in the developing cartridges for the respective colors, images were formed according to contact single-component developing method.

For tests, the peripheral velocity of the organic photoreceptor was set to 180 mm/s. The development rollers are set to have a peripheral velocity ratio of 2 relative to the organic photoreceptor. The peripheral velocity difference between the organic photoreceptor and the transfer belt as the intermediate transfer medium is set such that the rotation of the transfer belt 3 is faster than the organic photoreceptor by 3%. Since some previous experiments showed flush in transferred images with the ratio exceeding 3%, the upper limit was set to 3%. The aforementioned regulating condition of the toner regulating blade was changed to have a carrying amount of toner on the development roller from 0.300 $mg/cm^2$ to 0.400 $mg/cm^2$. The dark potential of the photoreceptor was set to −600 V, the light potential thereof was set to −60 V, and the developing bias was set to −200 V. The development roller and the supply roller were set to have the same potential. The primary transfer voltage was +300 V.

After a character image corresponding to color original containing 5% each color was successively printed on 10000 sheets of paper, the total amount of four color toners collected by cleaning the photoreceptor and the intermediate transfer belt was measured. The results are shown in FIG. 12. It is found from the results shown in FIG. 12 that the cleaning amount of toner is reduced by setting the work function of the organic photoreceptor to be larger than the work function of the toner.

EXAMPLE 5

By using a full-color printer of a tandem type as shown in FIG. 4 in which the toner 1 through the toner 4 were filled in the development cartridges for the four colors, respectively, images were made according to the non-contact single-component developing method. The organic photoreceptors used in this example were each made in the same manner as the organic photoreceptor (OPC 1), but employing an aluminum pipe of 30 mm in diameter as the conductive substrate. The development rollers and the regulating blades having the same structure as mentioned above were employed. The intermediate transfer medium according as the product example of the transfer belt (1) was employed. The regulating blades for the respective colors were set to have a carrying amount of toner from 0.300 $mg/cm^2$ to 0.400 $mg/cm^2$.

After a character image corresponding to color original containing 5% each color was successively printed on 10000 sheets of paper with a developing bias applied under condition that an alternating current (AC) to be superimposed on a direct current (DC) of −200 V was set to have a frequency of 2.5 kHz and a P—P voltage of 1400 V, the total amount of four color toners collected by cleaning the four photoreceptors and the intermediate transfer belt was about 38 g. This means that the cleaning toner amount can be reduced to about ⅓ of the expected amounts of toners collected in a cleaning toner container. It is found from this result that the transfer efficiency is improved and the cleaning amount of toner is thus reduced by setting the work function of the organic photoreceptor to be substantially the same as or larger than the work function of the toner.

Now, the invention according to claims 10 through 17 will be described.

The image forming apparatus comprises a latent image carrier, and a developing means for forming a negatively chargeable toner layer on a toner carrier by a toner layer thickness regulating member, wherein an electrostatic latent image on the latent image carrier is developed with the toner to form a visible image and the visible image is transferred to an intermediate transfer medium. The image forming apparatus is characterized in that the work function ($\Phi_{TM}$) of the surface of the intermediate transfer medium is set to be larger than the work function ($\Phi_t$) of the toner.

If negatively chargeable toner particles on the toner carrier are regulated into a thin layer (the number of stories in the layer is 2 or less) for uniformly negatively charging the toner, the amount of carrying toner particles is reduced, thus making the charge of the toner too high. Accordingly, the number of excessively negatively charged toner particles, i.e. over-charged toner particles, should be increased, with the result that toner particles strongly adhere to the intermediate transfer medium, thus unfortunately lowering the secondary transfer efficiency.

To solve the above problems, the work function ($\Phi_{TM}$) of the surface of the intermediate transfer medium is set to be larger than the work function ($\Phi_t$) of the toner so as to reduce the charge of excessively charged toner particles to be transferred to the intermediate transfer medium, thereby increasing the secondary transfer efficiency at the intermediate transfer medium.

By setting a peripheral velocity difference between the latent image carrier and the intermediate transfer medium, the excessive charge of the toner can be reduced. In this case, the peripheral velocity difference between the latent image carrier and the intermediate transfer medium is set not to exceed 5%, thereby inhibiting occurrence of flush during transfer operation and thus practically obtaining high-quality images. Toner particles adhering to the latent image carrier is positively charged because of the peripheral velocity difference, thereby reducing the amount of charge in negative polarity. The peripheral velocity difference between the latent image carrier and the intermediate transfer medium is preferably in a range from 0.3% to 3%.

The developing means regulates the toner layer thickness on the toner carrier to have 2 stories or less and controls the toner carrying amount A ($mg/cm^2$) to satisfy:

$$A=0.058D\pm0.1,$$

and preferably satisfy:

$$A=0.058D\pm0.05,$$

wherein D is the mean particle diameter ($\mu$m) of the toner based on the number.

The peripheral velocity ratio of the development roller relative to the latent image carrier is set to in a range from 1.2 to 2.5, preferably from 1.4 to 2.2 because of the regulation of thin layer, and the rotational directions of the latent image carrier and the development roller are set to have the same direction at a portion where they are in contact with or confront each other.

The developer is a negatively chargeable toner and the latent image carrier is a negatively chargeable organic photoreceptor. The negatively chargeable toner has a degree of circularity of 0.94 or more and has a mean particle diameter of 4.5 $\mu$m to 9 $\mu$m based on the number.

EXAMPLE 6

By using a four-cycle full-color printer of an intermediate transfer medium type as shown in FIG. 3 in which the toner 1 through the toner 4 were filled in the development cartridges for the four colors, respectively, images were made according to the non-contact single-component developing method under the same conditions of Example 1. Image forming was conducted with a developing bias applied under condition that an AC to be superimposed on a DC developing bias of −200 V was set to have a frequency of 2.5 kHz and a P—P voltage of 1400 V.

After a character image corresponding to color original containing 5% each color was successively printed on 10000 sheets of paper with a combination of the organic photoreceptor (OPC 2) as a hard photoreceptor and the transfer belt (1) of the present invention or the transfer belt (2) of a comparative example, the total amount of four color toners collected by cleaning the photoreceptor and the intermediate transfer belt was measured. The results are shown in FIG. 13. The regulating blades for the respective colors were set to have a carrying amount of toner from 0.310 mg/cm$^2$ to 0.400 mg/cm$^2$.

It is found from the results shown in FIG. 13 that the cleaning amount of toner can be reduced by setting the work function of the transfer belt to be larger than the work function of the toner. Since the toner is regulated in thin layer, the toner tends to be excessively charged. As the toner comes in contact with the transfer belt, the amount of charge of the toner is lowered to an amount of charge suitable for facilitating the transfer of toner. This may be the reason that the cleaning amount is reduced. To the contrary, in case of setting the work function of the transfer belt to be smaller than that of toner, the amount of charge may be increased not reduced so that the transfer efficiency was reduced and the cleaning amount is increased.

EXAMPLE 7

By using an organic photoreceptor (which was the same as OPC 3, but using a nickel electroforming pipe of OPC 5 instead of the aluminum pipe as the conductive substrate thereof and of which work function was 5.50 eV) i.e. an elastic photoreceptor into a four-cycle full-color printer of an intermediate transfer medium type as shown in FIG. 3 provided with the aforementioned development rollers and the aforementioned regulating blades, a combination of the toner 5 obtained in the above and the intermediate transfer belt (1) obtained in the above was employed to make image forming tests of the contact single-component developing method.

For tests, the peripheral velocity of the organic photoreceptor was set to 180 mm/s. The development rollers are set to have a peripheral velocity ratio of 2 relative to the organic photoreceptor. The peripheral velocity difference between the organic photoreceptor and the transfer belt as the intermediate transfer medium is set such that the rotation of the transfer belt is faster than the organic photoreceptor by 3%. Since some previous experiments showed flush in transferred images with the ratio exceeding 3%, the upper limit was set to 3%. The aforementioned regulating condition of the toner regulating blade was changed to have a carrying amount of toner on the development roller from 0.294 mg/cm$^2$ to 0.436 mg/cm$^2$. After an original image of 5% duty was successively printed on two sheets of paper under the condition, the charging property of the toner on the development roller was measured by a commercial charge distribution measuring system (E-SPART III available from Hosokawa Micron Corporation). The results of the measurements are shown in FIG. 14. The dark potential of the photoreceptor was set to −600 V, the light potential thereof was set to −60 V, and the developing bias was set to −200 V. The development roller and the supply roller were set to have the same potential. The transfer voltage applied to the primary transfer portion was +350 V.

Solid image was printed by the four-cycle full-color printer. The densities of the solid image portions, the degree of fog toner on the photoreceptor, and the degree of reverse transfer toner were measured. The densities of solid image portions, the degree of fog toner on the photoreceptor, and the degree of reverse transfer toner were measured according as Example 6. The results are shown in FIG. 15.

It is found that high transfer efficiency can be obtained and the amount of fog and the amount reverse transfer toner can be reduced, by setting the toner carrying amount to be in a range obtained from the aforementioned expression with the substitution of the value 6.3 of the mean particle diameter of the toner 5.

EXAMPLE 8

By using a four-cycle full-color printer of the intermediate transfer medium type as shown in FIG. 3 in which the toner 5 through the toner 8 were set in the developing cartridges for the respective colors, images were formed according to contact single-component developing method under the same condition as Example 7. The regulating blades for the respective colors were set to have a carrying amount of toner from 0.300 mg/cm$^2$ to 0.400 mg/cm$^2$.

After a character image corresponding to color original containing 5% each color was successively printed on 10000 sheets of paper, with a combination of the organic photoreceptor (OPC 3 of Example 7) as an elastic photoreceptor and the transfer belt (1) of the present invention or the transfer belt (2) of a comparative example, the total amount of four color toners collected by cleaning the photoreceptor and the intermediate transfer belt was measured. The results are shown in FIG. 16.

It is found from the results shown in FIG. 16 that the cleaning amount of toner can be reduced by setting the work function of the transfer belt to be larger than the work function of the toner. By this setting, exchange of charge between the toner and the transfer belt is caused, thus making the amount of charge of the toner to be an amount of charge suitable for the transfer. For making the amount of charge close to the suitable amount, it is advantageous that the transfer belt has a work function larger than that of the toner.

EXAMPLE 9

By using a full-color printer of a tandem type as shown in FIG. 4 in which the toner 1 through the toner 4 were filled in the development cartridges for the four colors, respectively, images were made according to the non-contact single-component developing method. The organic photoreceptors used in this example were each made in the same manner as the organic photoreceptor (OPC 2), but employing an aluminum pipe of 30 mm in diameter as the conductive substrate. The development rollers and the regulating blades having the same structure as mentioned above were employed. The intermediate transfer medium according as the product example of the transfer belt (1) was employed. The regulating blades for the respective colors were set to have a carrying amount of toner from 0.300 mg/cm$^2$ to 0.400 mg/cm$^2$.

After a character image corresponding to color original containing 5% each color was successively printed on 10000 sheets of paper with a developing bias applied under condition that an AC to be superimposed on a DC of −200 V was set to have a frequency of 2.5 kHz and a P—P voltage of 1400 V, the total amount of four color toners collected by cleaning the four photoreceptors and the intermediate transfer belt was about 40 g. This means that the cleaning toner amount can be reduced to about ⅓ of the expected amounts of toners collected in a cleaning toner container. It is found from this result that the transfer efficiency is improved and the cleaning amount of toner is thus reduced by setting the work function of the organic photoreceptor to be substantially the same as or larger than the work function of the toner.

What we claim is:

1. An image forming apparatus comprising: a latent image carrier; and a developing means for forming a negatively chargeable toner layer composed of two stories or less on a toner carrier by a toner layer thickness regulating member, wherein an electrostatic latent image on the latent image carrier is developed with said toner to form a visible image and said visible image is transferred to a transfer medium, said image forming apparatus being characterized in that the work function ($\Phi_{opc}$) of the surface of said latent image carrier is set to be larger than the work function ($\Phi_t$).

2. An image forming apparatus as claimed in claim 1, wherein said latent image carrier is a negatively chargeable organic photoreceptor so that the image forming apparatus conduct the reversal development.

3. An image forming apparatus as claimed in claim 1, wherein the peripheral velocity ratio said toner carrier relative to said latent image carrier is set in a range from 1.2 to 2.5.

4. An image forming apparatus as claimed in claim 1, wherein the peripheral velocity difference between the latent image carrier and the intermediate transfer medium is set not to exceed 5%.

5. An image forming apparatus as claimed in claim 1, wherein said developing means controls the toner carrying amount A (mg/cm$^2$) to satisfy:

$$A=0.058D\pm0.1,$$

wherein D is the mean particle diameter ($\mu$m) of the toner based on the number.

6. An image forming apparatus as claimed in claim 5, wherein the degree of circularity of said toner is 0.94 or more.

7. An image forming apparatus as claimed claim 6, wherein the mean particle diameter of said toner is from 4.5 $\mu$m to 9 $\mu$m based on the number.

8. An image forming apparatus as claimed in claim 1, wherein the image forming apparatus is a full-color image forming apparatus of an intermediate transfer type employing an intermediate transfer medium.

9. An image forming apparatus as claimed claim 8, wherein the intermediate transfer medium is of a belt type.

10. An image forming apparatus comprising: a latent image carrier; and a developing means for forming a negatively chargeable toner layer on a toner carrier by a toner layer thickness regulating member, wherein an electrostatic latent image on the latent image carrier is developed with said toner to form a visible image and said visible image is transferred to an intermediate transfer medium, said image forming apparatus being characterized in that the work function ($\Phi_{TM}$) of the surface of the intermediate transfer medium is set to be larger than the work function ($\Phi_t$) of the toner.

11. An image forming apparatus as claimed in claim 10, wherein said latent image carrier is a negatively chargeable organic photoreceptor so that the image forming apparatus conduct the reversal development.

12. An image forming apparatus as claimed in claim 10, wherein the peripheral velocity of the intermediate transfer medium is set to have a difference from the peripheral velocity of said latent image carrier.

13. An image forming apparatus as claimed in claim 10, wherein said developing means regulates the toner layer thickness on the toner carrier to have 2 stories or less by the toner layer thickness regulating member and controls the toner carrying amount A (mg/cm$^2$) to satisfy:

$$A=0.058D\pm0.1,$$

wherein D is the mean particle diameter ($\mu$m) of the toner based on the number.

14. An image forming apparatus as claimed in claim 13, wherein the degree of circularity of said toner is 0.94 or more.

15. An image forming apparatus as claimed claim 14, wherein the mean particle diameter of said toner is from 4.5 $\mu$m to 9 $\mu$m based on the number.

16. An image forming apparatus as claimed in claim 10, wherein the image forming apparatus is a full-color image forming apparatus of an intermediate transfer type employing an intermediate transfer medium.

17. An image forming apparatus as claimed claim 16, wherein the intermediate transfer medium is of a belt type.

* * * * *